US010297212B2

(12) United States Patent
Sako et al.

(10) Patent No.: US 10,297,212 B2
(45) Date of Patent: May 21, 2019

(54) DISPLAY DEVICE AND DISPLAY DEVICE DRIVE METHOD

(71) Applicant: Japan Display Inc., Tokyo (JP)

(72) Inventors: Kazuhiko Sako, Tokyo (JP); Tsutomu Harada, Tokyo (JP)

(73) Assignee: Japan Display Inc., Tokyo (JP)

( * ) Notice: Subject to any disclaimer, the term of this patent is extended or adjusted under 35 U.S.C. 154(b) by 142 days.

(21) Appl. No.: 14/667,981

(22) Filed: Mar. 25, 2015

(65) Prior Publication Data

US 2015/0279285 A1 Oct. 1, 2015

(30) Foreign Application Priority Data

Mar. 31, 2014 (JP) ..... 2014-072543

(51) Int. Cl.

*G09G 3/34* (2006.01)
*G09G 3/36* (2006.01)
*G09G 5/00* (2006.01)

(52) U.S. Cl.

CPC ..... *G09G 3/3607* (2013.01); *G09G 3/3406* (2013.01); *G09G 3/3611* (2013.01); *G09G 5/003* (2013.01); *G09G 5/006* (2013.01); *G09G 2310/08* (2013.01); *G09G 2320/0626* (2013.01); *G09G 2330/021* (2013.01); *G09G 2360/145* (2013.01); *G09G 2370/08* (2013.01)

(58) Field of Classification Search

None

See application file for complete search history.

(56) References Cited

U.S. PATENT DOCUMENTS

2007/0285379 A1* 12/2007 Jung ..... G09G 3/342 345/102
2008/0129680 A1 6/2008 Kimura et al.
2009/0002400 A1* 1/2009 Ha ..... G09G 3/3406 345/690
2010/0164922 A1* 7/2010 Nose ..... G09G 3/3406 345/207
2014/0267471 A1 9/2014 Harada et al.
2014/0292840 A1 10/2014 Harada et al.

FOREIGN PATENT DOCUMENTS

JP 2008-139569 6/2008
JP 2014-178369 9/2014
JP 2014-191338 10/2014

* cited by examiner

*Primary Examiner* — Christopher R Lamb
(74) *Attorney, Agent, or Firm* — K&L Gates LLP

(57) ABSTRACT

A display device includes an image display panel on which pixels are arranged, a backlight which lights the image display panel from a rear of the image display panel, a first device which controls the backlight, and a second device which controls the image display panel. The first device generates an image signal, outputs the image signal to the second device, determines a light source lighting amount of the backlight on the basis of the image signal by blocks obtained by dividing a display surface of the image display panel and luminance distribution information on the backlight stored in advance, and controls the backlight by the light source lighting amount. The second device acquires the image signal, converts the image signal to a display signal for controlling display of the image display panel, and controls the image display panel.

5 Claims, 14 Drawing Sheets

DISPLAY DEVICE AND DISPLAY DEVICE DRIVE METHOD

CROSS REFERENCES TO RELATED APPLICATIONS

The present application claims priority to Japanese Priority Patent Application JP 2014-072543 filed in the Japan Patent Office on Mar. 31, 2014, the entire content of which is hereby incorporated by reference.

BACKGROUND

The embodiments discussed herein are related to a display device and a display device drive method.

In recent years, for example, the screen definition of display devices has become higher and the color reproduction ranges of display devices have become larger. The power consumption of such high performance display devices has increased. The technique of exercising division drive control in a backlight according to an input image signal for reducing power consumption is known as a technique for solving this problem (see, for example, Japanese Laid-open Patent Publication No. 2008-139569).

SUMMARY

There are provided a display device and a display device drive method which reduce power consumption.

According to an aspect, there is provided a display device including an image display panel on which pixels are arranged, a backlight which lights the image display panel from a rear thereof, a first device which controls the backlight, and a second device which controls the image display panel, the first device generating an image signal, outputting the image signal to the second device, determining a light source lighting amount of the backlight on the basis of the image signal by blocks obtained by dividing a display surface of the image display panel and luminance distribution information on the backlight stored in advance, and controlling the backlight by the light source lighting amount, the second device acquiring the image signal, converting the image signal to a display signal for controlling display of the image display panel, and controlling the image display panel.

The object and advantages of the invention will be realized and attained by means of the elements and combinations particularly pointed out in the claims.

It is to be understood that both the foregoing general description and the following detailed description are exemplary and explanatory and are not restrictive of the invention.

Additional features and advantages are described herein, and will be apparent from the following Detailed Description and the figures.

DETAILED DESCRIPTION

Figure 1:
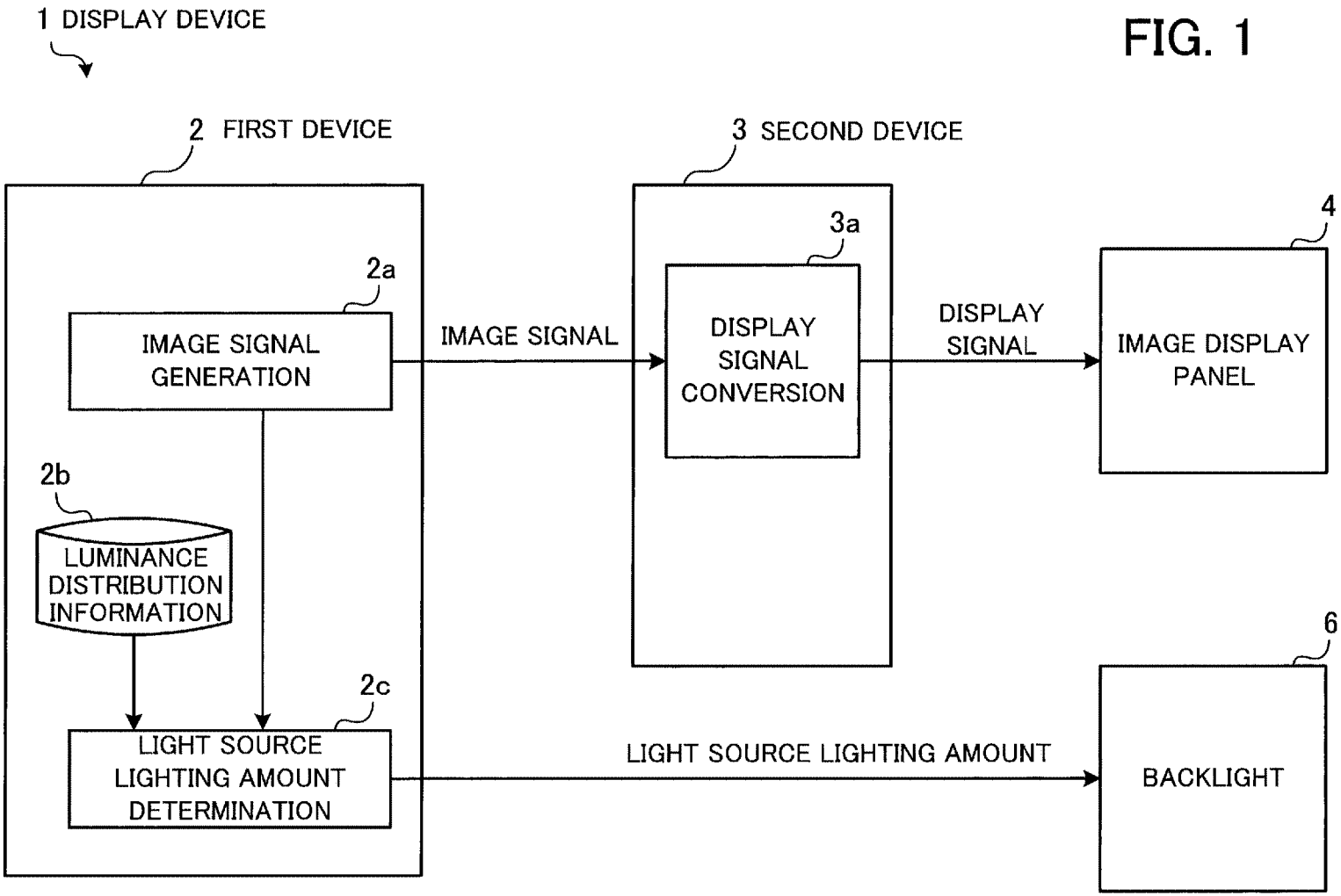
FIG. 1 illustrates an example of the structure of a display device according to a first embodiment.

Embodiments will now be described with reference to the accompanying drawings.

Disclosed embodiments are simple examples. It is a matter of course that a proper change which suits the spirit of the invention and which will readily occur to those skilled in the art falls within the scope of the present invention. Furthermore, in order to make description clearer, the width, thickness, shape, or the like of each component may schematically be illustrated in the drawings compared with the real state. However, it is a simple example and the interpretation of the present invention is not restricted.

In addition, in the present invention and the drawings the same components that have already been described in previous drawings are marked with the same numerals and detailed descriptions of them may be omitted according to circumstances.

(First Embodiment)

A display device according to a first embodiment will be described by the use of FIG. 1. FIG. 1 illustrates an example of the structure of a display device according to a first embodiment. A display device 1 illustrated in FIG. 1 includes a first device 2, a second device 3, an image display panel 4, and a backlight 6.

The first device 2 includes a storage section which stores luminance distribution information 2*b* in advance, and performs image signal generation 2*a* and light source lighting amount determination 2*c*. The first device 2 controls the backlight 6 by a determined lighting amount in the light source.

The second device 3 performs display signal conversion 3*a* and controls the image display panel 4 by a display signal obtained by the conversion.

The image display panel 4 includes (P×Q) pixels arranged in a matrix. The image display panel 4 displays an image on the display surface on the basis of a display signal inputted from the second device 3.

The backlight 6 lights the image display panel 4 from a rear thereof. The backlight 6 emits, for example, white light from an emission surface opposite the display surface of the image display panel 4 to the display surface. Furthermore, in the backlight 6 division drive control by which a light source lighting amount is adjusted for controlling luminance according to blocks is exercised. With the division drive control, for example, a plurality of light sources which operate independently of one another are used, a lighting pattern in which a light source lighting amount of each light source is adjusted is determined, and each light source is driven on the basis of the lighting pattern. In addition, the division drive control may be exercised by arranging a plurality of adjustment sections between a light source and the image display panel 4, each of which adjusts the amount of light which reaches the image display panel 4 from the light source. In this case, a light source lighting amount may be kept constant. In the following description the backlight 6 includes a plurality of light sources. An adjusted value of the light amount by each adjustment section is determined in the same way as determination of a lighting amount in a light source.

Steps performed by the first device 2 and the second device 3 will be described.

In the image signal generation 2*a,* the first device 2 generates an image signal and outputs it to the second device 3. The image signal includes an image signal value $x1_{(p,q)}$ for a first primary color, an image signal value $x2_{(p,q)}$ for a second primary color, and an image signal value $x3_{(p,q)}$ for a third primary color.

In the light source lighting amount determination 2*c,* the first device 2 determines a lighting amount in a light source of the backlight 6 on the basis of an image signal for each of divided blocks and the luminance distribution information 2*b*. The divided blocks are obtained by dividing the display surface of the image display 4. Luminance information on the backlight 6 observed on the display surface for each of the plurality of light sources lighted at a determined amount of light is stored in the luminance distribution information 2*b*. By the way, when display is performed by the image display panel 4, the luminance of the display is determined according to an image signal. With division drive control in the backlight 6, the luminance of the backlight 6 is adjusted by blocks according to luminance needed for display which is obtained from an image signal. In the light source lighting amount determination 2*c,* a light source lighting amount of each light source which realizes required luminance for each block obtained from an image signal is determined by the use of the luminance distribution information 2*b*. The backlight 6 is controlled by the determined light source lighting amount.

In the display signal conversion 3*a,* the second device 3 acquires an image signal from the first device 2 and converts the image signal to a display signal for controlling display by the image display panel 4. Furthermore, the second device 3 makes a correction when necessary so as to meet the display settings of the image display panel 4.

With the display device 1 having the above structure, the second device 3 converts an image signal generated by the first device 2 to a display signal for controlling the image display panel 4 and the first device 2 performs light source lighting amount determination for controlling the backlight 6.

For example, if the second device 3 performs the whole of a display control process after image signal generation, that is to say, exercises the whole of control of the image display panel 4 and control of the backlight 6, then the processing load on the second device 3 will be heavy. Light source lighting amount determination which needs a vast amount of luminance distribution information is performed especially in division drive control in a backlight. Accordingly, performing display signal conversion and light source lighting amount determination in parallel causes an increase in processing load. In addition, it is desirable that the second device 3 complete these steps after input of an image signal and before the next frame cycle. In order to perform these two steps in a determined frame cycle, a processor which can perform processing at a higher speed is needed. With the first device 2, on the other hand, a processor which can perform processing at a high speed is needed to perform a vast amount of image signal generation. After image signal generation, however, the processing load on the first device 2 is light until the next frame cycle. If both of the first device 2 and the second device 3 can perform processing at a high speed, then the power consumption of the entire display device 1 will increase. In the display device 1, the first device 2 performs at least a part of the light source lighting amount determination performed after the image signal generation. As a result, the processing load on the second device 3 is light compared with a case where the second device 3 performs all of the display control process. Accordingly, the power consumption of the entire display device 1 is reduced. After the image signal generation 2*a,* the processing load on the first device 2 is comparatively light until the next frame cycle. Therefore, even if the first device 2 performs at least a part of the light source lighting amount determination, the possibility that a delay occurs in image signal generation is small. In addition, the distribution of the light source lighting amount determination is set properly.

(Second Embodiment)

A display device according to a second embodiment will now be described. First the structure of a display device will be described, and then a process performed by the display device will be described.

Figure 2:
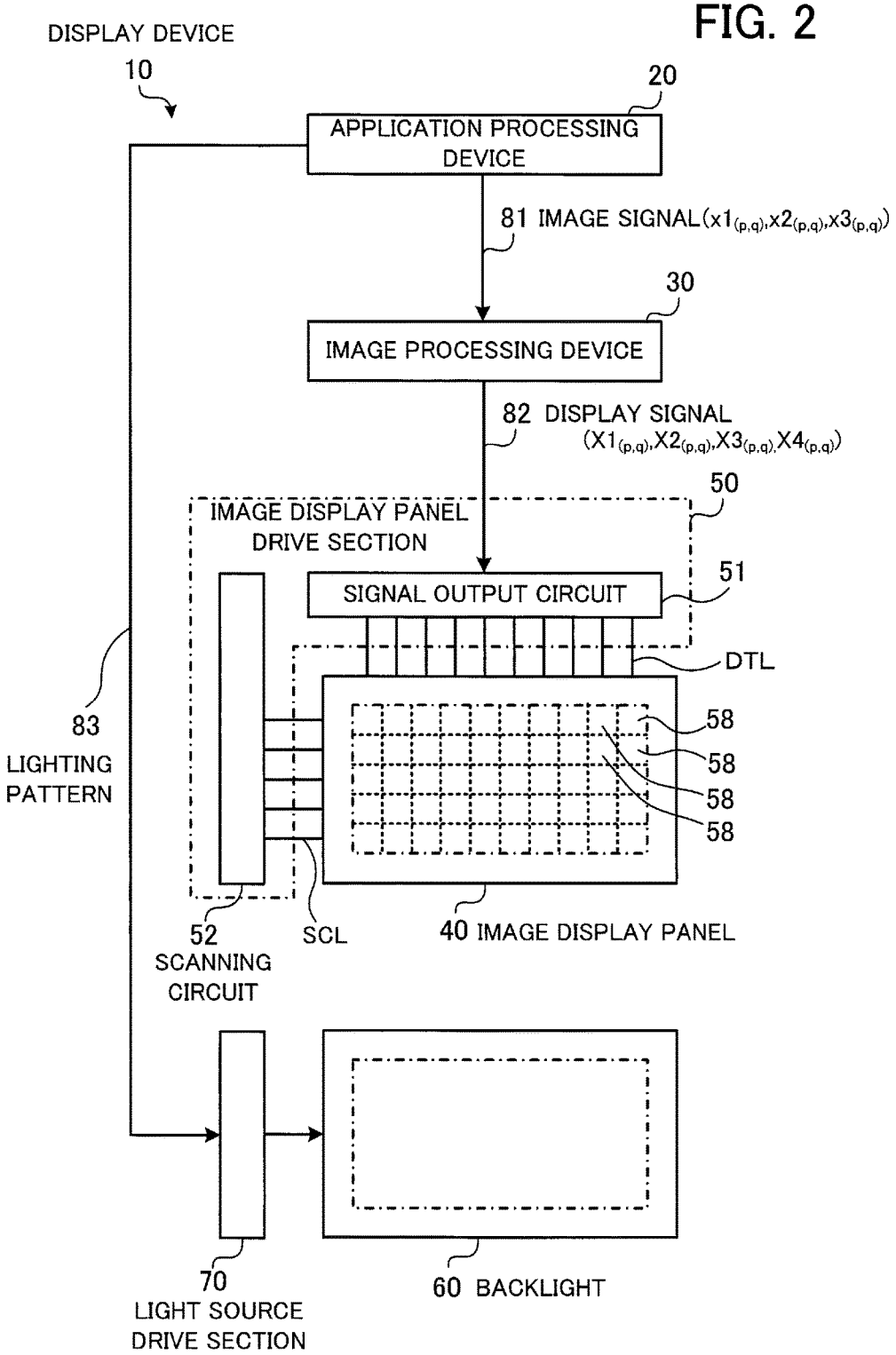
FIG. 2 illustrates an example of the structure of a display device according to a second embodiment.

FIG. 2 illustrates an example of the structure of a display device according to a second embodiment.

A display device 10 illustrated in FIG. 2 includes an application processing device 20, an image processing device 30, an image display panel 40, an image display panel drive section 50, a backlight 60, and a light source drive section 70. The display device 10 is an embodiment of the display device 1 illustrated in FIG. 1.

The application processing device 20 outputs an image signal 81 to the image processing device 30. The image signal 81 includes an image signal value $x1_{(p,q)}$ for a first primary color, an image signal value $x2_{(p,q)}$ for a second primary color, and an image signal value $x3_{(p,q)}$ for a third primary color. In the second embodiment it is assumed that the first primary color is red, the second primary color is green, and the third primary color is blue. Furthermore, the application processing device 20 is connected to the light source drive section 70 which drives the backlight 60, and division-controls the luminance of the backlight 60 by blocks. The application processing device 20 is an embodiment of the first device 2.

The image processing device 30 is connected to the image display panel drive section 50 which drives the image display panel 40. The image processing device 30 converts the image signal 81 to a display signal 82 displayed by each pixel including a subpixel which displays a fourth color. At this time luminance information by pixels on the backlight 60 is reflected in the display signal 82. In addition to a display signal value $X1_{(p,q)}$ corresponding to a first subpixel, a display signal value $X2_{(p,q)}$ corresponding to a second subpixel, and a display signal value $X3_{(p,q)}$ corresponding to a third subpixel, the display signal 82 includes a display signal value $X4_{(p,q)}$ corresponding to a fourth subpixel which displays the fourth color. In the second embodiment it is assumed that the fourth color is white. The image processing device 30 is an embodiment of the second device 3.

The image display panel 40 is made up of (P×Q) pixels 58 arranged in a two-dimensional matrix. The image display panel drive section 50 includes a signal output circuit 51 and a scanning circuit 52 and drives the image display panel 40.

The backlight 60 is arranged on the rear side of the image display panel 40 and emits light to the image display panel 40. By doing so, the backlight 60 lights the image display panel 40. The light source drive section 70 controls the luminance of the backlight 60 by blocks on the basis of a lighting pattern 83 outputted from the application processing device 20.

The image display panel 40 and the backlight 60 will now be described by the use of FIGS. 3 and 4 respectively.

The image display panel 40 will be described first. FIG. 3 illustrates an example of the arrangement of pixels on the image display panel in the second embodiment.

Figure 3:
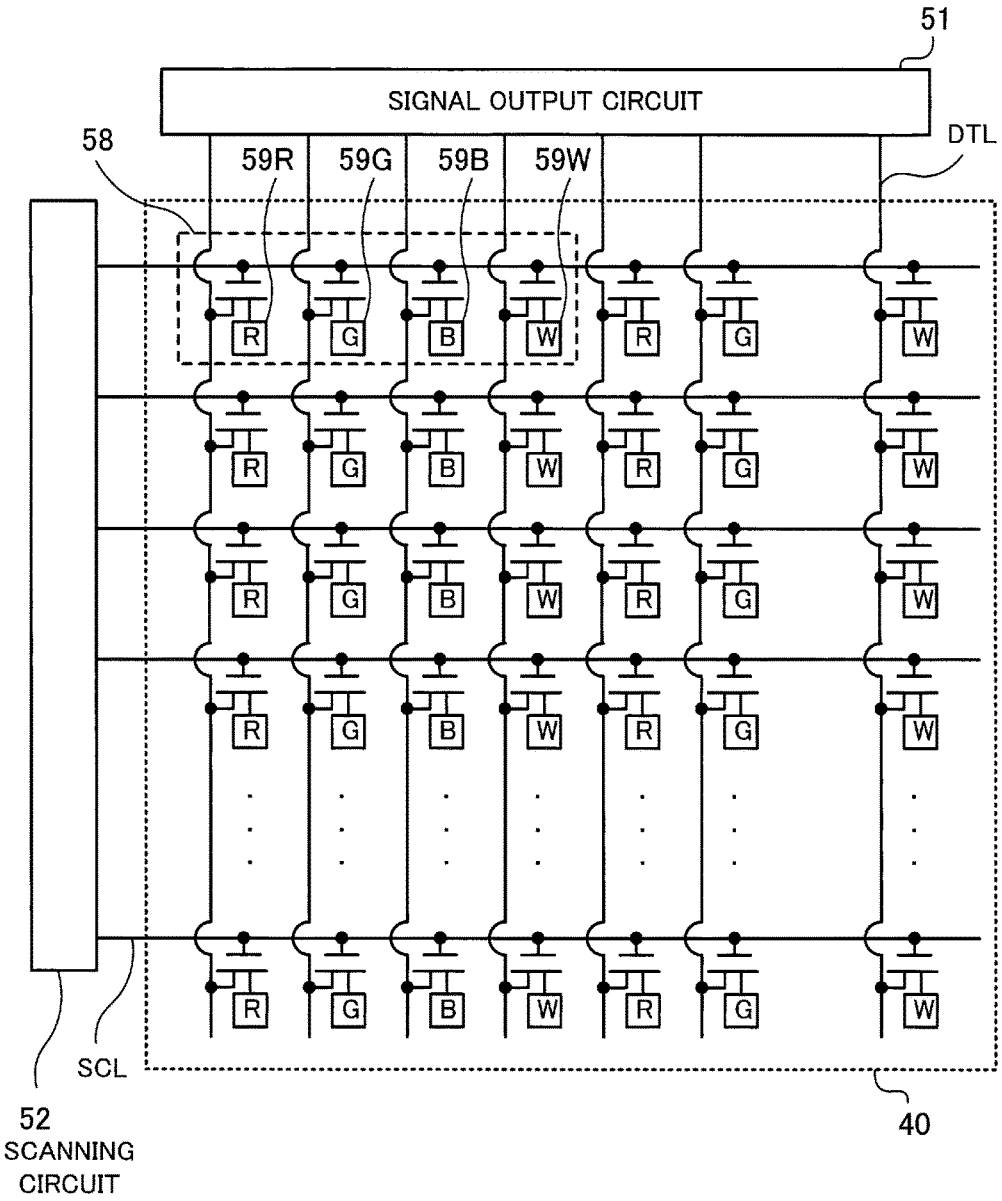
FIG. 3 illustrates an example of the arrangement of pixels on an image display panel in the second embodiment.

With the image display panel 40 illustrated in FIG. 3, each of the pixels 58 arranged in a two-dimensional matrix includes a first subpixel 59R, a second subpixel 59G, a third subpixel 59B, and a fourth subpixel 59W. In the second embodiment, the first subpixel 59R displays red, the second subpixel 59G displays green, the third subpixel 59B displays blue, and the fourth subpixel 59W displays white. However, colors which the first subpixel 59R, the second subpixel 59G, and the third subpixel 59B display are not limited to them. The first subpixel 59R, the second subpixel 59G, and the third subpixel 59B may display other different colors. For example, the first subpixel 59R, the second subpixel 59G, and the third subpixel 59B may display the complementary colors of red, green, and blue respectively. Furthermore, a color which the fourth subpixel 59W displays is not limited to white. For example, the fourth subpixel 59W may display yellow. However, white is effective in reducing power consumption. It is desirable that if the first subpixel 59R, the second subpixel 59G, the third subpixel 59B, and the fourth subpixel 59W are lighted at the same light source lighting amount, the fourth subpixel 59W is brighter than the first subpixel 59R, the second subpixel 59G, and the third subpixel 59B. If there is no need to distinguish among the first subpixel 59R, the second subpixel 59G, the third subpixel 59B, and the fourth subpixel 59W, then the term "subpixels 59" will be employed in the following description.

More specifically, the image display panel 40 is a transmission type color liquid crystal display panel. Color filters which transmits red light, green light, and blue light are disposed between the first subpixel 59R, the second subpixel 59G, and the third subpixel 59B, respectively, and an observer of an image. Furthermore, a color filter is not disposed between the fourth subpixel 59W and an observer of an image. The fourth subpixel 59W may include a transparent resin layer in place of a color filter. If a color filter is not disposed between the fourth subpixel 59W and an observer of an image, a great difference in level appears between the fourth subpixel 59W and the first subpixel 59R, the second subpixel 59G, and the third subpixel 59B. The formation of a transparent resin layer prevents a great difference in level from appearing between the fourth subpixel 59W and the first subpixel 59R, the second subpixel 59G, and the third subpixel 59B.

The signal output circuit 51 and the scanning circuit 52 included in the image display panel drive section 50 are electrically connected to the subpixels 59R, 59G, 59B, and 59W of the image display panel 40 via signal lines DTL and signal lines SCL respectively. The subpixels 59 are connected not only to the signal lines DTL but also to the signal lines SCL via switching elements (such as TFTs (Thin Film Transistors)). The image display panel drive section 50 selects subpixels 59 by the scanning circuit 52 and outputs image signals in order from the signal output circuit 51. By doing so, the image display panel drive section 50 controls the operation (light transmittance) of the subpixels 59.

The backlight 60 will now be described by the use of FIG. 4. FIG. 4 illustrates an example of the structure of the backlight in the second embodiment.

Figure 4:
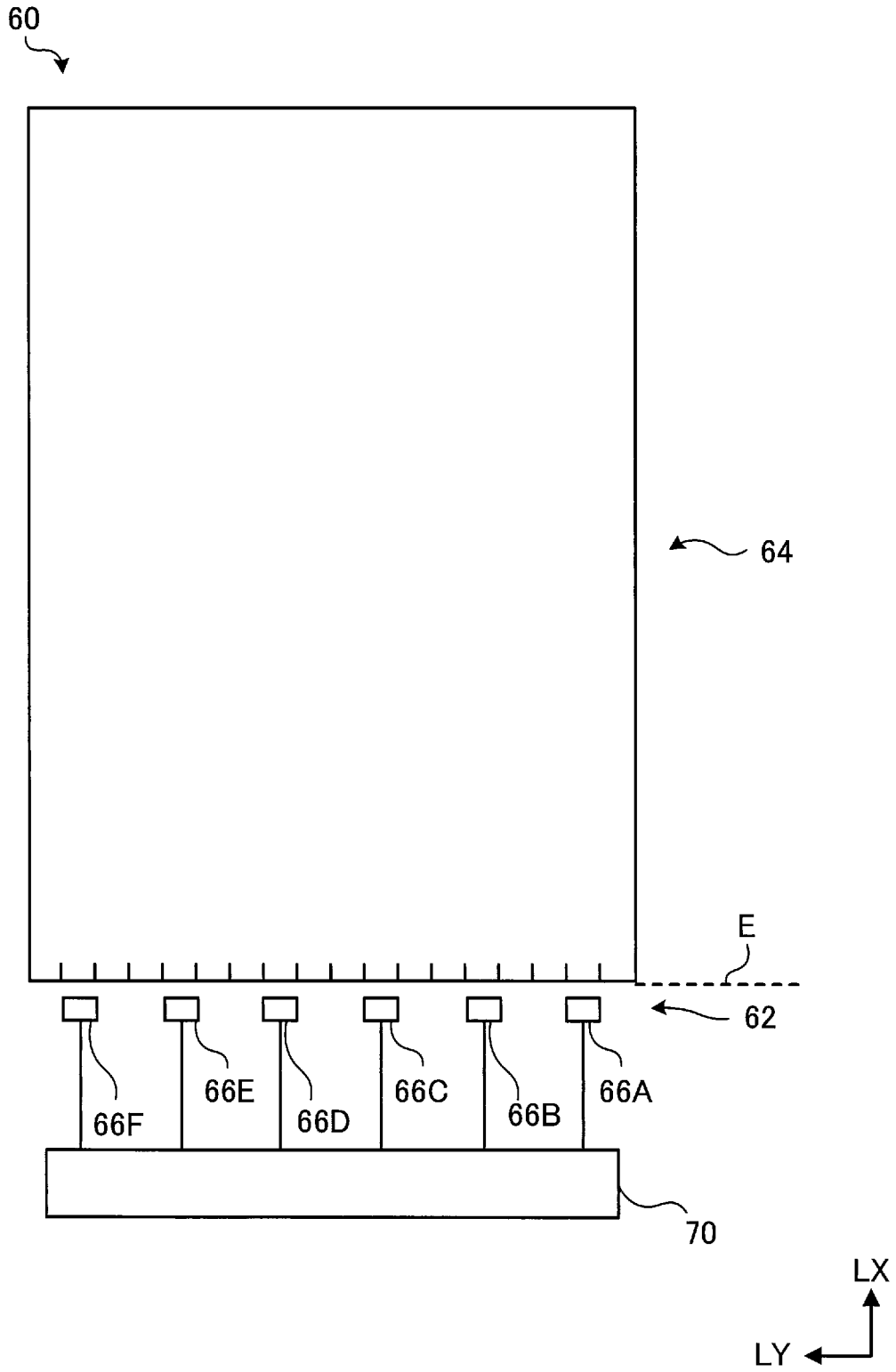
FIG. 4 illustrates an example of the structure of a backlight in the second embodiment.

The backlight 60 illustrated in FIG. 4 includes a light guide plate 64 and a sidelight light source 62 in which light sources 66A, 66B, 66C, 66D, 66E, and 66F are arranged opposite an incident surface E that is at least one side of the light guide plate 64. The light sources 66A, 66B, 66C, 66D, 66E, and 66F are LEDs (Light-Emitting Diodes) which emit light of the same color (white, for example), and control current values or duty ratios independently of one another. If there is no need to distinguish among the light sources 66A, 66B, 66C, 66D, 66E, and 66F, then the term "light sources 66" will be employed in the following description. The light sources 66 are arranged along the one side of the light guide plate 64. It is assumed that the direction in which the light sources 66 are arranged is a light source arrangement direction LY. Light emitted from the light sources 66 is inputted from the incident surface E to the light guide plate 64 in an incident direction LX perpendicular to the light source arrangement direction LY. Furthermore, light which enters the light guide plate 64 is emitted from a surface opposite the image display panel 40. Lights which are emitted from the light sources 66 and which are emitted from the light guide plate 64 to a rear of the image display panel 40 have different luminance distributions according to the positions at which the light sources 66 are arranged.

The light source drive section 70 adjusts the values of current supplied to the light sources 66 or duty ratios on the basis of the lighting pattern 83 outputted from the application processing device 20. By doing so, the light source drive section 70 controls the amount of the lights of the light sources 66 and controls the luminance (intensity of the light) of the backlight 60.

Figure 5:
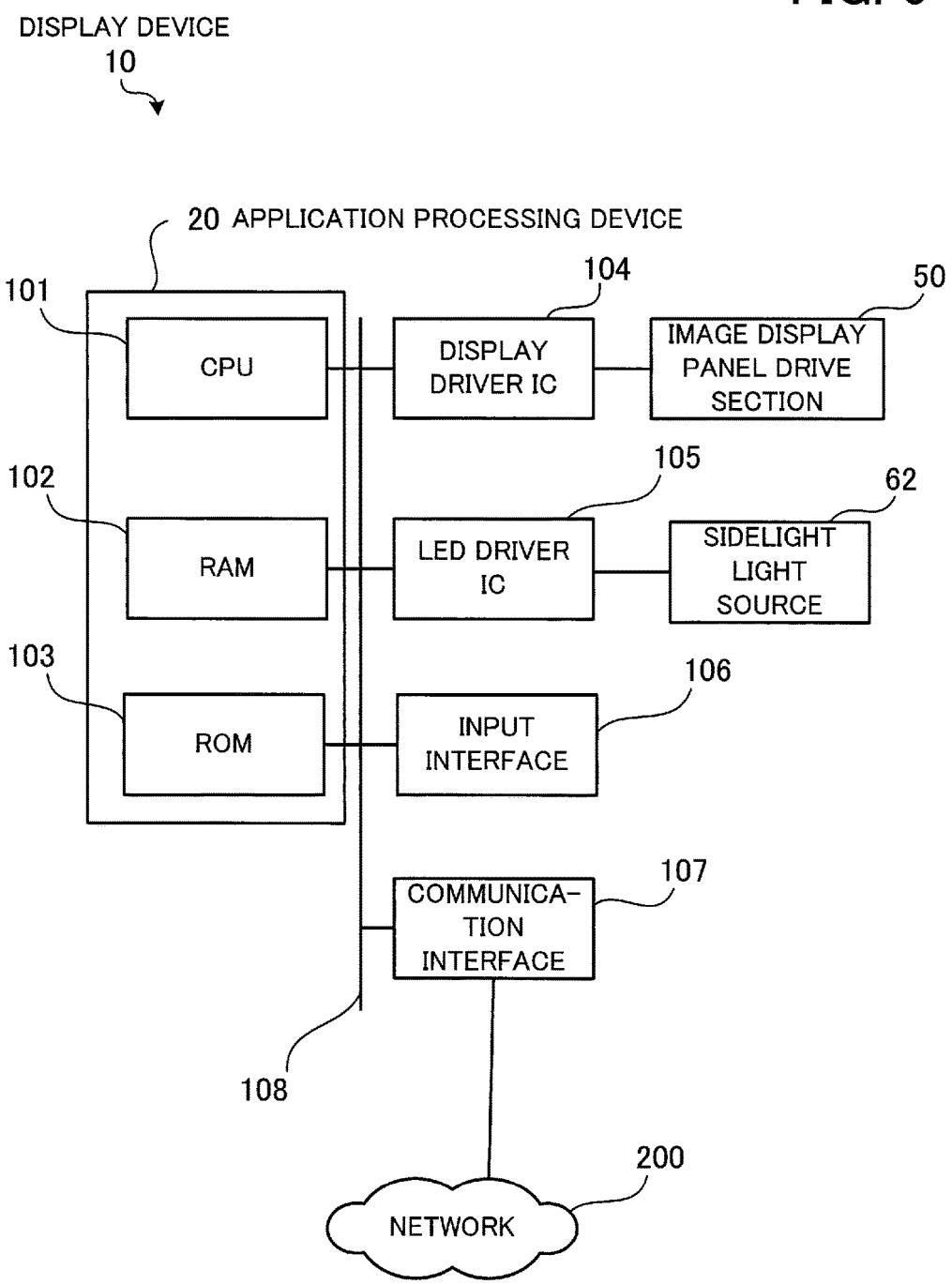
FIG. 5 illustrates an example of the hardware configuration of the display device according to the second embodiment.

The hardware configuration of the display device 10 will now be described. FIG. 5 illustrates an example of the hardware configuration of the display device according to the second embodiment.

The whole of the application processing device 20 of the display device 10 is controlled by a CPU (Central Processing Unit) 101. A RAM (Random Access Memory) 102, a ROM (Read Only Memory) 103, and a plurality of peripheral units are connected to the CPU 101 via a bus 108.

The RAM 102 is used as main storage of the application processing device 20. The RAM 102 temporarily stores at least a part of an OS (Operating System) program or an application program executed by the CPU 101. In addition, the RAM 102 stores various pieces of data which the CPU 101 needs to perform a process.

The ROM 103 is a read only semiconductor memory and stores an OS program, an application program, and fixed data which is not rewritten. Furthermore, a semiconductor memory, such as a flash memory, may be used as auxiliary storage in place of the ROM 103 or in addition to the ROM 103.

The plurality of peripheral units connected to the bus 108 are a display driver IC (Integrated Circuit) 104, an LED driver IC 105, an input interface 106, and a communication interface 107.

The image display panel drive section 50 is connected to the display driver IC 104. The display driver IC 104 outputs the display signal 82 to the image display panel drive section 50 to display an image on the image display panel 40.

The sidelight light source 62 is connected to the LED driver IC 105. The LED driver IC 105 drives the sidelight light source 62 according to the lighting pattern 83 and controls the luminance of the backlight 60.

An input device used for inputting a user's instructions is connected to the input interface 106. An input device, such as a keyboard, a mouse used as a pointing device, or a touch panel, is connected. The input interface 106 transmits to the CPU 101 a signal transmitted from the input device.

The communication interface 107 is connected to a network 200. The communication interface 107 transmits data to or receives data from another computer or a communication apparatus via the network 200.

By adopting the above hardware configuration, the processing functions in the second embodiment are realized. The above hardware configuration is an example and is changed according to circumstances.

As illustrated in FIG. 5, the processing functions of the application processing device 20 of the display device 10 are realized by the CPU 101. Furthermore, the processing functions of the image processing device 30 are realized by the display driver IC 104. Usually the processing speed of the CPU 101 is higher than that of a processor included in the display driver IC 104.

Figure 6:
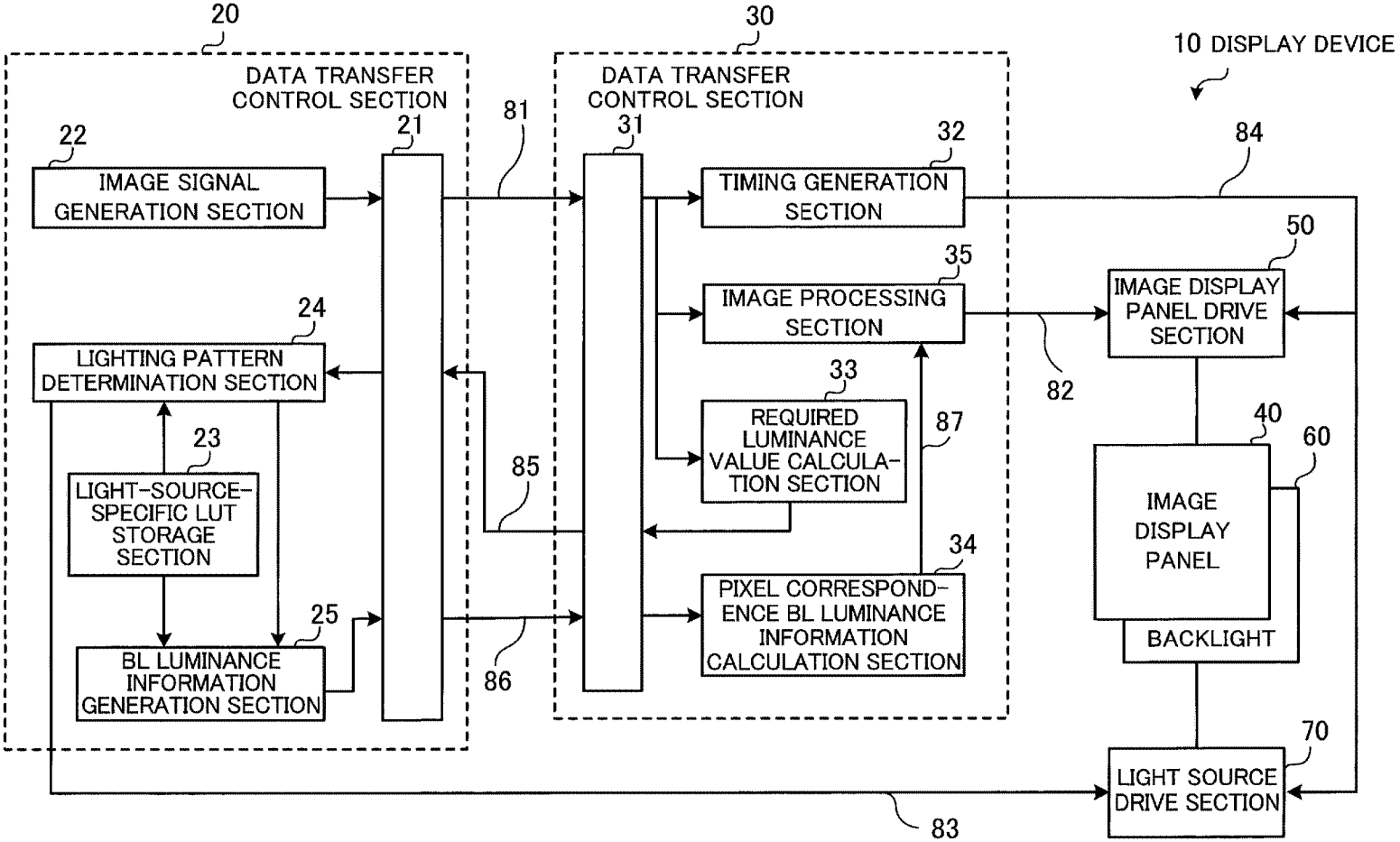
FIG. 6 is a functional block diagram of the display device according to the second embodiment.

The functions of the display device 10 will now be described. FIG. 6 is a functional block diagram of the display device according to the second embodiment.

In the display device 10, each of the application processing device 20 and the image processing device 30 performs a subprocess while transferring data to the other.

The application processing device 20 includes a data transfer control section 21, an image signal generation section 22, a light-source-specific lookup table (LUT) storage section 23, a lighting pattern determination section 24, and a backlight (BL) luminance information generation section 25. Furthermore, the image processing device 30 includes a data transfer control section 31, a timing generation section 32, a required luminance value calculation section 33, a pixel correspondence BL luminance information calculation section 34, and an image processing section 35.

Each section of the application processing device 20 will be described.

The data transfer control section 21 controls data transfer by which an image signal 81 and BL luminance information 86 are transferred to the image processing device 30 and by which a required luminance value 85 is received from the image processing device 30.

The image signal generation section 22 generates the image signal 81 every determined frame cycle and outputs it to the data transfer control section 21. The image signal 81 is generated every determined frame cycle by the image signal generation section 22 and includes an image signal value $x1_{(p,q)}$ for the first primary color, an image signal value $x2_{(p,q)}$ for the second primary color, and an image signal value $x3_{(p,q)}$ for the third primary color. The image signal 81 is transferred at determined timing from the data transfer control section 21 to the image processing device 30.

The light-source-specific LUT storage section 23 stores as luminance distribution information a luminance value detected in each area of a display surface at the time of lighting each light source 66 at a determined lighting amount. A luminance value of a representative pixel which represents pixels included in a determined area obtained by dividing the display surface is recorded in a tabular form in the luminance distribution information. A light-source-specific LUT is information specific to the display device 10, so it is created in advance and is stored in the light-source-specific LUT storage section 23.

Figure 7:
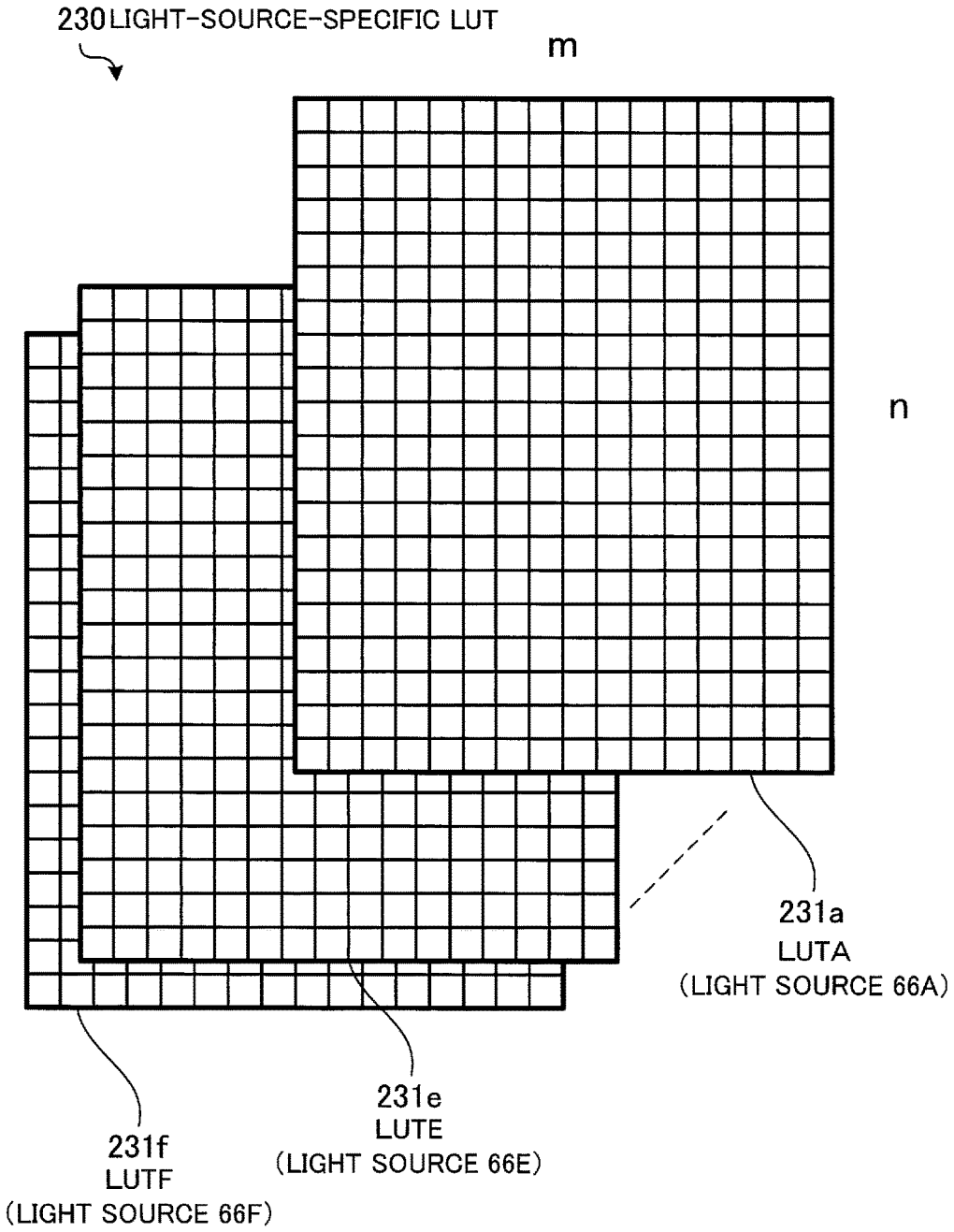
FIG. 7 illustrates light-source-specific LUTs in the second embodiment.

FIG. 7 illustrates light-source-specific LUTs in the second embodiment.

A light-source-specific LUT 230 is prepared for each of the light sources 66A, 66B, 66C, 66D, 66E, and 66F. Luminance values detected at representative pixels of (m×n) areas obtained by dividing the display surface at the time of lighting only the light source 66A are recorded in a tabular form in a LUTA 231*a*. Similarly, LUTs are created in the same way for the light sources 66B, 66C, 66D, 66E, and 66F. FIG. 7 illustrates a LUTE 231*e* for the light source 66E and a LUTF 231*f* for the light source 66F. If a luminance value of a representative pixel which represents a determined area is used, the size of the light-source-specific LUT 230 is small compared with a case where luminance values of all pixels in an area are registered. As a result, the storage capacity of the light-source-specific LUT storage section 23 is reduced. When a luminance value of each pixel is needed, it is calculated by interpolation calculation. The light-source-specific LUT 230 is information at the time of lighting one light source 66 at a time. However, a light-source-specific LUT at the time of simultaneously lighting a combination of the light sources 66A and 66B, a combination of the light sources 66C and 66D, or the like may be created and stored. This reduces the amount of work for creating light-source-specific LUTs and the storage capacity of the light-source-specific LUT storage section 23. A combination of one or more light sources is referred to as a light source unit. The light-source-specific LUT 230 is prepared for each light source unit. Furthermore, a luminance value is set in a corrected state in the light-source-specific LUT 230 so as to accommodate luminance irregularity correction. By using this light-source-specific LUT 230, luminance irregularity correction and lighting pattern determination are performed at the same time.

Description will return to FIG. 6.

The lighting pattern determination section 24 determines a lighting pattern of the sidelight light source 62 on the basis of the required luminance value 85 acquired from the image processing device 30 and the light-source-specific LUT 230. The lighting pattern determination section 24 may find a lighting pattern of the sidelight light source 62 by calculation. Furthermore, the lighting pattern determination section 24 may set a temporary lighting pattern of the sidelight light source 62, calculate luminance information on the entire backlight 60 for the temporary lighting pattern, compare the required luminance value 85 and the luminance information to make a correction, and determine a lighting pattern. The luminance information on the entire backlight 60 is found by calculating on the basis of the light-source-specific LUT 230 luminance information on each light source 66 at the time of lighting it according to the temporary lighting pattern and combining the luminance information on each light source 66. The lighting pattern determination section 24 outputs a determined lighting pattern 83 to the light source drive section 70 to control the backlight 60.

On the basis of the lighting pattern 83 and the light-source-specific LUT 230, the BL luminance information generation section 25 generates the BL luminance information 86 at the time of lighting the light sources 66 of the backlight 60 according to the lighting pattern 83. The BL luminance information 86 is luminance information on representative pixels registered in the light-source-specific LUT 230. The BL luminance information generation section 25 outputs the BL luminance information 86 to the data transfer control section 21. The BL luminance information 86 is transferred at determined timing from the data transfer control section 21 to the image processing device 30.

Each section of the image processing device 30 will now be described.

The data transfer control section 31 receives the image signal 81 and the BL luminance information 86 from the application processing device 20 and outputs the required luminance value 85 to the application processing device 20.

On the basis of the image signal 81, the timing generation section 32 generates a synchronization signal 84 every frame for synchronizing the operation timing of the image display panel drive section 50 with that of the light source drive section 70. The timing generation section 32 outputs the generated synchronization signal 84 to the image display panel drive section 50 and the light source drive section 70.

The required luminance value calculation section 33 acquires the image signal 81, analyzes it, and calculates the required luminance value 85 of the backlight 60. When the image signal 81 is converted to a display signal 82, the luminance of each pixel 58 including the fourth subpixel 59W can be adjusted. For example, if the luminance of each pixel 58 is increased, then the luminance of the backlight 60 can be reduced according to an increase in the luminance of each pixel 58. That is to say, there is a correspondence between an index for adjusting the luminance of each pixel 58 and an index for adjusting the luminance of the backlight 60. The index for adjusting the luminance of each pixel 58 is determined according to the image signal 81. The required luminance value calculation section 33 analyzes the image signal 81 by blocks and calculates an index corresponding to each block for adjusting the luminance of pixels 58 and an index associated with that index for adjusting the luminance of the backlight 60. An index for adjusting the luminance of the backlight 60 by blocks will be referred to as a block correspondence index. An index for increasing the luminance of each pixel 58 and an index associated with that index for reducing the luminance of the backlight 60 are found especially for division drive control in the backlight 60. A required luminance value of each block is calculated on the basis of a block correspondence index for reducing the luminance of the backlight 60. The required luminance value 85 of all blocks calculated is outputted to the application processing device 20 via the data transfer control section 31.

The pixel correspondence BL luminance information calculation section 34 acquires the BL luminance information 86, finds from the BL luminance information 86 pixel correspondence BL luminance information 87 including luminance information on each pixel 58, and outputs the pixel correspondence BL luminance information 87 to the image processing section 35. If the BL luminance information 86 is luminance information by pixels, then the BL luminance information 86 is the pixel correspondence BL luminance information 87. If the BL luminance information 86 is luminance information on representative pixels, then luminance information by pixels is calculated by interpolation calculation on the basis of luminance values of adjacent representative pixels. In this case, interpolation calculation is based on linear interpolation or polynomial interpolation such as cubic interpolation.

The image processing section 35 acquires the image signal 81 and the pixel correspondence BL luminance information 87 and converts the image signal 81 to the display signal 82. As stated above, when the image signal 81 is converted to the display signal 82, the luminance of each pixel 58 including the fourth subpixel 59W can be adjusted. The image processing section 35 acquires the luminance of the backlight 60 for a corresponding pixel 58 from the pixel correspondence BL luminance information 87 and adjusts the luminance of the corresponding pixel 58 according to the luminance of the backlight 60 for the corresponding pixel 58. As a result, proper display in which the luminance of the backlight 60 is compatible with that of each pixel 58 is performed. The image processing section 35 outputs the display signal 82 to the image display panel drive section 50.

The image display panel drive section 50 and the light source drive section 70 drive the image display panel 40 and the backlight 60, respectively, in synchronization with each other by the synchronization signal 84 outputted from the timing generation section 32. The image display panel drive section 50 performs display on the image display panel 40 by the display signal 82 inputted from the image processing device 30. The light source drive section 70 drives the backlight 60 according to the lighting pattern 83 inputted from the application processing device 20 in synchronization with the display signal 82.

Figure 8:
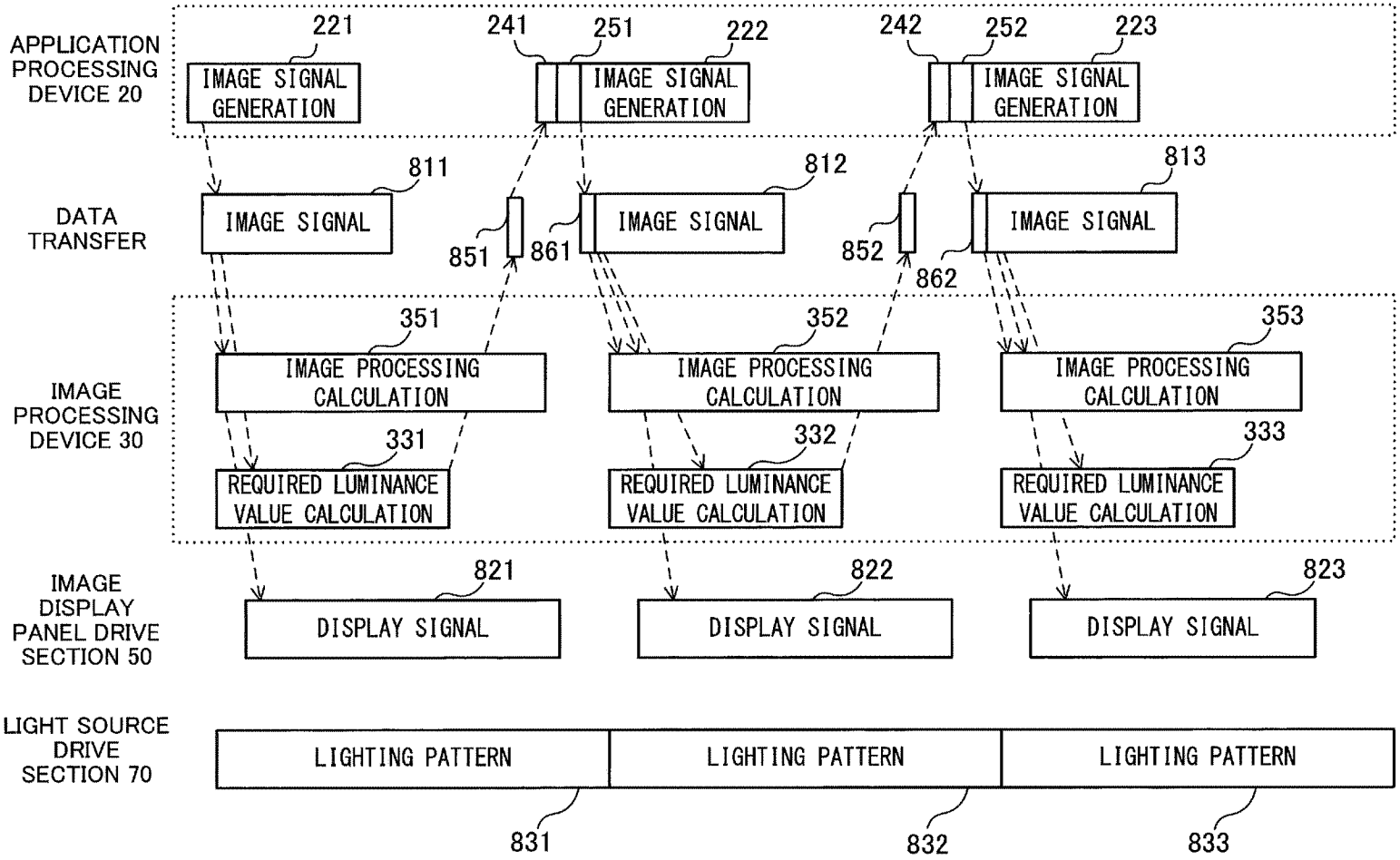
FIG. 8 illustrates the operation timing of the display device according to the second embodiment.

The operation of the display device 10 having the above structure will be described. FIG. 8 illustrates the operation timing of the display device according to the second embodiment.

The application processing device 20 generates an image signal 81 in a determined frame cycle. In the example of FIG. 8, for convenience, it is assumed that a frame which is begun by image signal generation 221 is frame 1, that a frame which is begun by the next image signal generation 222 is frame 2, and that a frame which is begun by image signal generation 223 is frame 3.

The operation in frame 1 will be described. The application processing device 20 outputs in order an image signal 811 which it generates in the image signal generation 221 to the image processing device 30 via the data transfer control section 21. In the image signal generation 221, the image signal 811 is generated by pixels in real time and is outputted in its original condition to the image processing device 30. Furthermore, the light source drive section 70 drives the backlight 60 according to a lighting pattern 831 which the lighting pattern determination section 24 determines before the beginning of frame 1.

The image signal 811 is inputted in order to the image processing device 30. The data transfer control section 31 of the image processing device 30 outputs the image signal 811 inputted in order to the timing generation section 32, the required luminance value calculation section 33, and the image processing section 35. Each of the timing generation section 32, the required luminance value calculation section 33, and the image processing section 35 begins its operation when input of the image signal 811 is begun.

When input of the image signal 811 is begun, the image processing section 35 begins an image processing calculation 351 and converts the image signal 811 to a display signal 821 in real time. The image processing section 35 outputs the display signal 821 after the conversion to the image display panel drive section 50 in order.

When input of the image signal 811 is begun, the required luminance value calculation section 33 begins a required luminance value calculation 331. The required luminance value calculation section 33 analyzes the image signal 811 by blocks and calculates a required luminance value. For example, when the image signal 811 is inputted by one block, the required luminance value calculation section 33 may calculate a required luminance value of the block. After the required luminance value calculation section 33 calculates required luminance values of all blocks, the required luminance value calculation section 33 outputs the calculated required luminance values 851 to the data transfer control section 31. The data transfer control section 31 outputs the required luminance values 851 in a period after the completion of the transfer of the image signal 811 by the application processing device 20 and before the beginning of the transfer of an image signal 812 in the next frame 2 by the application processing device 20.

The application processing device 20 receives the required luminance values 851. The lighting pattern determination section 24 performs lighting pattern determination 241 by the use of the required luminance values 851 and the image signal 811 generated in the image signal generation 221. The image signal 811 generated in the image signal generation 221 is held in the application processing device 20 and is used for performing a process. A lighting pattern 832 determined is used at the time of driving the backlight 60 in frame 2. In addition, the BL luminance information generation section 25 performs BL luminance information generation 251. The BL luminance information generation section 25 generates BL luminance information 861 on the basis of the determined lighting pattern 832 and the light-source-specific LUT 230 and outputs the BL luminance information 861 to the data transfer control section 21. The data transfer control section 21 transfers the BL luminance information 861 to the image processing device 30 at determined timing. The series of steps is performed before the beginning of the image signal generation 222 in frame 2.

In the example of FIG. 8, the BL luminance information 861 is transferred to the image processing device 30 before the beginning of output of the image signal 812 in frame 2. The data transfer control section 31 of the image processing device 30 receives the BL luminance information 861 and outputs it to the pixel correspondence BL luminance information calculation section 34. The pixel correspondence BL luminance information calculation section 34 converts the BL luminance information 861 to pixel correspondence information. The pixel correspondence BL luminance information calculation section 34 outputs pixel correspondence BL luminance information 87, which is pixel correspondence information, to the image processing section 35.

As has been described, in frame 1, the image processing calculation 351 and the required luminance value calculation 331 are performed in parallel in the image processing device 30 on the basis of the image signal 811 transferred in order from the application processing device 20. The display signal 821 converted from the image signal 811 in the image processing calculation 351 is outputted to the image display panel drive section 50 to perform display. Furthermore, the required luminance values 851 calculated in the required luminance value calculation 331 are transferred to the application processing device 20 and the application processing device 20 performs the lighting pattern determination 241 and the BL luminance information generation 251. The BL luminance information 861 is transferred to the image processing device 30 before the beginning of frame 2.

The operation in frame 2 will be described. The application processing device 20 outputs in order the image signal 812 which it generates in the image signal generation 222 to the image processing device 30 via the data transfer control section 21. The image signal 812 in frame 2 is inputted in order to the image processing device 30.

When input of the image signal 812 is begun, the image processing section 35 of the image processing device 30 begins an image processing calculation 352 and converts the image signal 812 to a display signal 822. At this time the image processing section 35 uses the pixel correspondence BL luminance information 87 based on the BL luminance information 861 inputted at the end of frame 1 from the application processing device 20 for reflecting luminance information on the backlight 60 corresponding to each pixel 58 in the display signal 822. The image processing section 35 outputs the display signal 822 in order to the image display panel drive section 50 to exercise display control of the image display panel 40. In addition, the required luminance value calculation section 33 begins a required luminance value calculation 332 in parallel with the image processing calculation 352 and calculates required luminance values 852. The required luminance values 852 are transferred from the data transfer control section 31.

The application processing device 20 receives the required luminance values 852 and performs lighting pattern determination 242 and BL luminance information generation 252 by the use of the required luminance values 852 and the image signal 812. BL luminance information 862 generated is outputted to the image processing device 30 before the transfer of an image signal 813 in frame 3. Display control of the image display panel 40 is to be exercised in real time. However, there is no need to control the backlight 60 in real time. If the luminance of the backlight 60 is compatible with that of each pixel 58, then the display performance of the display device 10 is not affected.

After that, the same operation is repeated.

As has been described, the image processing device 30 performs the image processing calculation 351 of the input image signal 811 and the required luminance value calculation 331 in parallel in real time. On the other hand, the application processing device 20 performs the lighting pattern determination 241 and the BL luminance information generation 251 which there is no need to perform in real time. This reduces the processing load on the image processing device 30. Furthermore, a part of the calculations are performed by the application processing device 20, so an entire processing speed is improved.

As is clear from FIG. 8, for example, the lighting pattern 832 according to which the backlight 60 is controlled is based on the image signal 811 generated one frame before. However, few cases are known where image signals change considerably in consecutive frames. Furthermore, the BL luminance information 861 on the backlight 60 at this time is inputted to the image processing device 30, is converted to the pixel correspondence BL luminance information 87, and is inputted to the image processing section 35. Therefore, the image processing section 35 properly adjusts the luminance of the backlight 60.

The operation of an image processing device 30 which exercises display control of the image display panel 40 and drive control of the backlight 60 will now be described as an example for comparison. In this case, the image processing device 30 performs the lighting pattern determination 241 and the BL luminance information generation 251 in succession after the required luminance value calculation 331. In many cases, as stated above, the processing capability of a processor in the image processing device 30 is lower than that of a processor in an application processing device 20. In addition, these steps are to be performed in parallel with the image processing calculation 351. As a result, the processing load on the image processing device 30 is very heavy. This has an adverse influence on the speed at which the image processing calculation 351 is performed, and a delay may occur in conversion to the display signal 821 which is to be performed in real time.

In the second embodiment the application processing device 20 shares drive control in the backlight 60 with the image processing device 30 in a time period for which, because the application processing device 20 has ended the image signal generation 221, the processing load on the application processing device 20 is light. Accordingly, the image signal processing is not affected. Furthermore, in many cases the processing speed of the application processing device 20 is higher than that of the image processing device 30. As a result, even if data transfer time is taken into consideration, the application processing device 20 can end a step before the beginning of the next frame.

Figure 9:
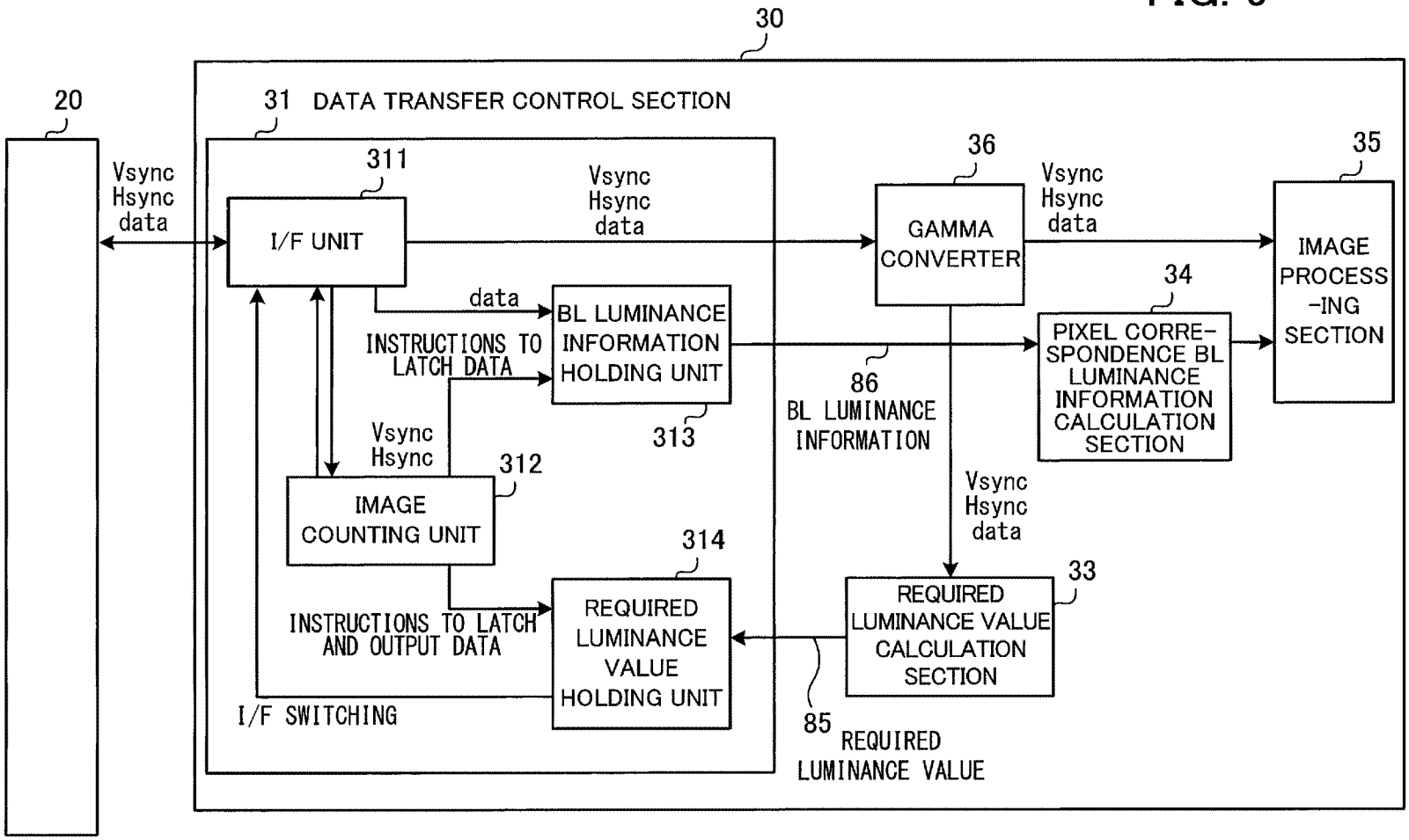
FIG. 9 illustrates an example of the structure of a data transfer control section in the second embodiment.
Figure 10:
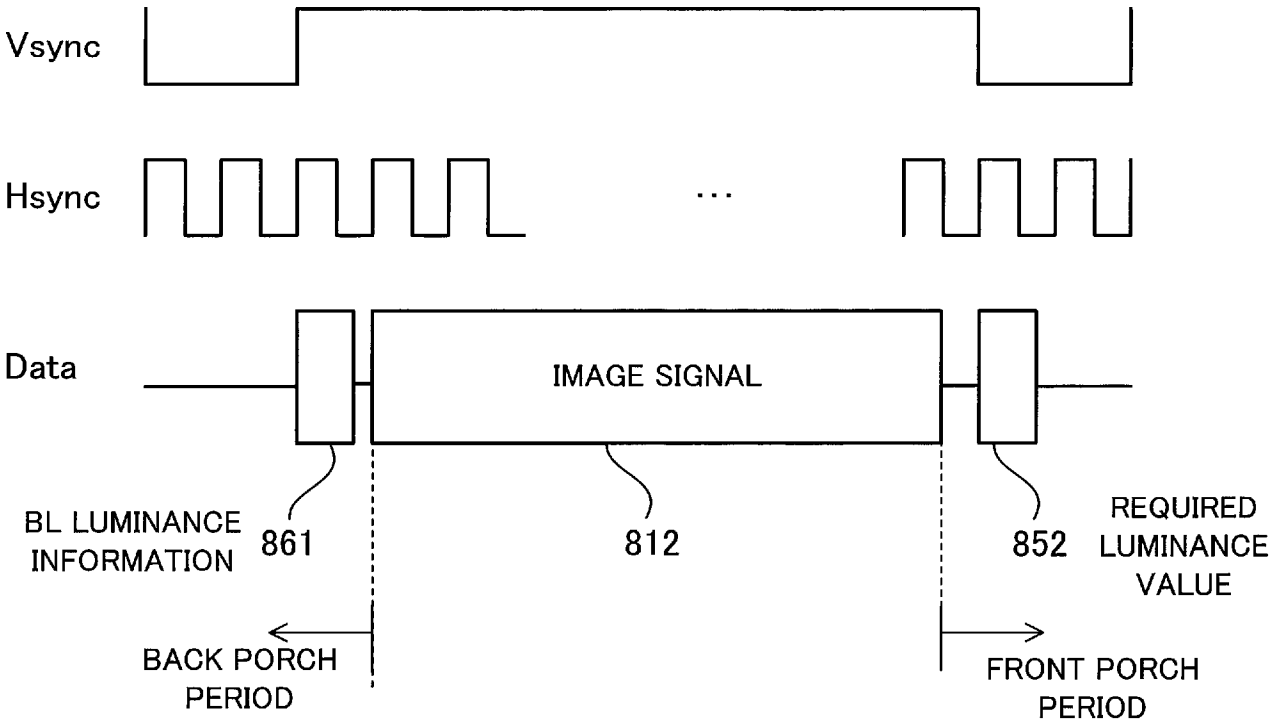
FIG. 10 illustrates operation timing in data transfer in the second embodiment.

Data transfer control will now be described by the use of FIGS. 9 and 10. FIG. 9 illustrates an example of the structure of the data transfer control section in the second embodiment. FIG. 9 illustrates a part of the image processing device 30 including the data transfer control section 31.

The data transfer control section 31 includes an I/F (interface) unit 311, an image counting unit 312, a BL luminance information holding unit 313, and a required luminance value holding unit 314. "Vsync" and "Hsync" are signals for determining operation timing, and "data" is transferred data.

The image processing device 30 illustrated in FIG. 9 includes a gamma converter 36 between the data transfer control section 31 and the image processing section 35 and the required luminance value calculation section 33. The gamma converter 36 converts the format of image data inputted from the application processing device 20 to an internal processing format in the image processing device 30. If there is also a need to convert the format of an image signal inputted to the timing generation section 32 illustrated in FIG. 6, the image processing section 35, or the required luminance value calculation section 33 to an internal processing format, then gamma conversion is performed.

The I/F unit 311 exercises switching control of an I/F data bus. When a required luminance value 85 held in the required luminance value holding unit 314 is outputted, the I/F unit 311 performs switching of a data bus.

The image counting unit 312 gives the BL luminance information holding unit 313 instructions to latch BL luminance information 86 which is data appendant to the leading Hsync after Vsync. Furthermore, the image counting unit 312 counts up Hsync, gives the required luminance value holding unit 314 instructions to latch and output a result after the last effective Hsync, and gives the I/F unit 311 instructions to transfer data held in the required luminance value holding unit 314.

The BL luminance information holding unit 313 holds data inputted from the application processing device 20 as the BL luminance information 86.

The required luminance value holding unit 314 holds the required luminance value 85 calculated by the required luminance value calculation section 33 until it is transferred to the application processing device 20.

The operation of the data transfer control section 31 having the above structure will be described. FIG. 10 illustrates operation timing in data transfer in the second embodiment.

The BL luminance information holding unit 313 of the data transfer control section 31 latches BL luminance information 861 which is data appendant to the leading Hsync after Vsync. The pixel correspondence BL luminance information calculation section 34 reads out and uses information held in the BL luminance information holding unit 313.

The image counting unit 312 counts up the following Hsync and transmits in order data to the last effective Hsync from the I/F unit 311 to the gamma converter 36. This data is converted as an image signal 812 by the gamma converter 36 and is outputted to the required luminance value calculation section 33 and the image processing section 35.

After the effective Hsync, a required luminance value 852 is outputted to the application processing device 20 via the required luminance value holding unit 314.

As has been described, with the display device 10 BL luminance information 86 and a required luminance value 85 are transferred in a period for which an image signal 81 is not transferred. As a result, there is no need to arrange another signal line for data transfer. In the example of FIG. 10, the BL luminance information 861 is transferred from the application processing device 20 to the image processing device 30 in a period (back porch period) after the end of a frame before a frame by which the image signal 812 is transferred. The required luminance value 852 is transferred from the image processing device 30 to the application processing device 20 in a period (front porch period) before the beginning of the next frame.

A case where the expansion coefficient $\alpha$ is used as the index for increasing the luminance of each pixel 58 or the index for reducing the luminance of the backlight 60 will now be described.

Each pixel 58 of the display device 10 includes the fourth subpixel 59W which outputs the fourth color (white). This extends the dynamic range of a value in reproduction HSV color space which can be reproduced by the display device 10. "H" represents hue, "S" represents saturation, and "V" represents a value.

Figure 11:
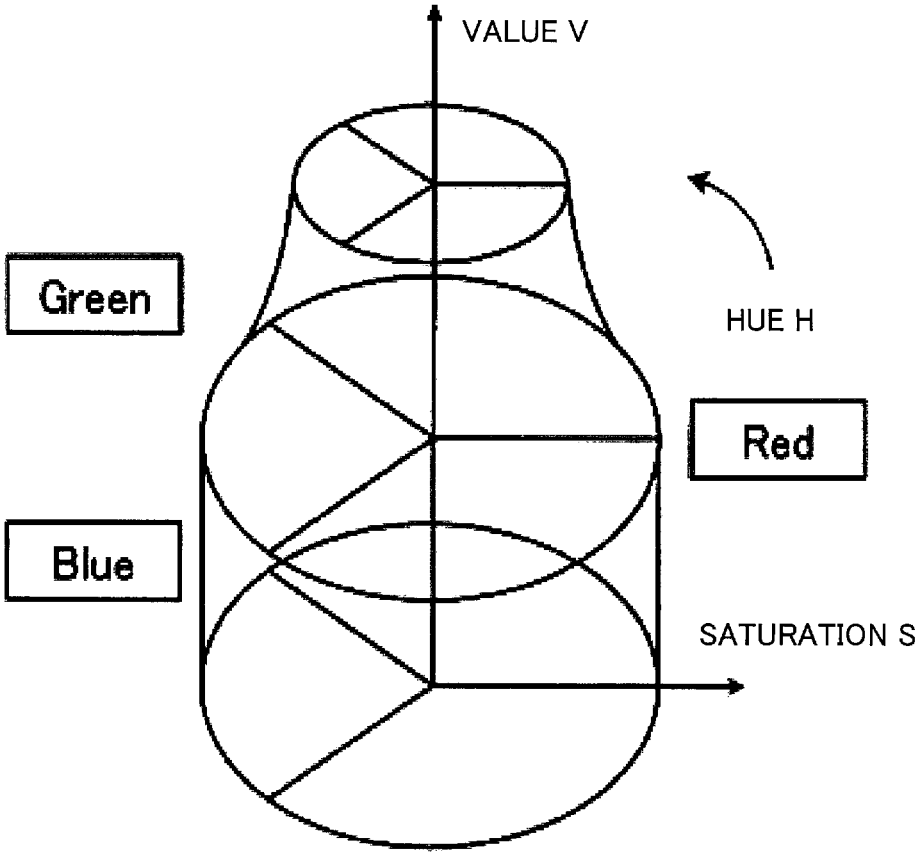
FIG. 11 is a schematic view of reproduction HSV color space which can be reproduced by the display device according to the second embodiment.

FIG. 11 is a schematic view of reproduction HSV color space which can be reproduced by the display device according to the second embodiment. As illustrated in FIG. 11, the reproduction HSV color space to which the fourth color has been added has a shape obtained by putting an approximately trapezoid solid in which, as the saturation S increases, the maximum value of the value V becomes smaller on cylindrical HSV color space which the first subpixel 59R, the second subpixel 59G, and the third subpixel 59B display. The image processing device 30 stores the maximum value Vmax(S) of a value expressed with the saturation S in the reproduction HSV color space which has been extended by adding the fourth color as a variable. That is to say, the image processing device 30 stores the maximum value Vmax(S) of a value by the coordinates (values) of the saturation S and the hue H for the solid shape of the reproduction HSV color space illustrated in FIG. 11.

An image signal 81 includes image signal values corresponding to the first, second, and third primary colors, so HSV color space of the image signal 81 has a cylindrical shape, that is to say, has the same shape as a cylindrical portion of the reproduction HSV color space illustrated in FIG. 11 has. Accordingly, a display signal 82 is calculated as an expanded image signal obtained by expanding the image signal 81 to make it fall within the reproduction HSV color space. The image signal 81 is expanded by the use of the expansion coefficient $\alpha$ determined by comparing the value levels of subpixels of the image signal 81 in the reproduction HSV color space. By expanding the level of the image signal 81 by the use of the expansion coefficient $\alpha$, a display signal value corresponding to the fourth subpixel 59W can be made large. This increases the luminance of an entire image. At this time the luminance of the backlight 60 is reduced to $1/\alpha$ according to an increase in the luminance of the entire image caused by expanding by the use of the expansion coefficient $\alpha$. By doing so, display is performed with exactly the same luminance as with the image signal 81.

The expansion of an image signal 81 will now be described.

A display signal value $X1_{(p,q)}$ corresponding to the first subpixel 59R, a display signal value $X2_{(p,q)}$ corresponding to the second subpixel 59G, and a display signal value $X3_{(p,q)}$ corresponding to the third subpixel 59B for a (p, q)th pixel (or a combination of the first subpixel 59R, the second subpixel 59G, and the third subpixel 59B) are expressed as:

$$X1_{(p,q)}=\alpha\cdot x1_{(p,q)}-\chi\cdot X4_{(p,q)} \quad (1)$$

$$X2_{(p,q)}=\alpha\cdot x2_{(p,q)}-\chi\cdot X4_{(p,q)} \quad (2)$$

$$X3_{(p,q)}=\alpha\cdot x3_{(p,q)}-\chi\cdot X4_{(p,q)} \quad (3)$$

where $\alpha$ is an expansion coefficient and $\chi$ is a constant which depends on the display device 10. $\chi$ will be described later.

In addition, a display signal value $X4_{(p,q)}$ is calculated on the basis of the product of $Min_{(p,q)}$ and the expansion coefficient $\alpha$, where $Min_{(p,q)}$ is the minimum value of image signal values $x1_{(p,q)}$, $x2_{(p,q)}$, and $x3_{(p,q)}$. To be concrete, a display signal value $X4_{(p,q)}$ is found on the basis of $$X4_{(p,q)}=Min_{(p,q)}\cdot\alpha/\chi \quad (4)$$

In expression (4), the product of $Min_{(p,q)}$ and the expansion coefficient $\alpha$ is divided by $\chi$. However, another calculation method may be adopted. Furthermore, the expansion coefficient $\alpha$ is determined every image display frame.

These points will now be described.

On the basis of an image signal 81 for the (p, q)th pixel including an image signal value $x1_{(p,q)}$ corresponding to the first primary color, an image signal value $x2_{(p,q)}$ corresponding to the second primary color, and an image signal value $x3_{(p,q)}$ corresponding to the third primary color, usually saturation $S_{(p,q)}$ and value $V(S)_{(p,q)}$ in the cylindrical HSV color space are found from $$S_{(p,q)}=(Max_{(p,q)}-Min_{(p,q)})/Max_{(p,q)} \quad (5)$$

$$V(S)_{(p,q)}=Max_{(p,q)} \quad (6)$$

where $Max_{(p,q)}$ is the maximum value of the image signal value $x1_{(p,q)}$, the image signal value $x2_{(p,q)}$, and the image signal value $x3_{(p,q)}$ included in the image signal 81, $Min_{(p,q)}$, as stated above, is the minimum value of the image signal value $x1_{(p,q)}$, the image signal value $x2_{(p,q)}$, and the image signal value $x3_{(p,q)}$, the saturation S has a value in the range of 0 to 1, and the value V(S) has a value in the range of 0 to $(2^n-1)$, where n is a display gradation bit number.

A color filter may not be disposed between the fourth subpixel 59W which displays white and an observer of an image. If a light source lights the first subpixel 59R which displays the first primary color, the second subpixel 59G which displays the second primary color, the third subpixel 59B which displays the third primary color, and the fourth subpixel 59W which displays the fourth color at the same light source lighting amount, then the fourth subpixel 59W is brighter than the first subpixel 59R, the second subpixel 59G, and the third subpixel 59B. It is assumed that when a signal value corresponding to the maximum value of display signal values corresponding to the first subpixels 59R is inputted to a first subpixel 59R, a signal value corresponding to the maximum value of display signal values corresponding to the second subpixels 59G is inputted to a second subpixel 59G, and a signal value corresponding to the maximum value of display signal values corresponding to the third subpixels 59B is inputted to a third subpixel 59B, the luminance of a set of a first subpixel 59R, a second subpixel 59G, and a third subpixel 59B included in each pixel 58 or the luminance of a set of first subpixels 59R, second subpixels 59G, and third subpixels 59B included in a group of pixels 58 is $BN_{1-3}$. Furthermore, it is assumed that when a signal value corresponding to the maximum value of display signal values corresponding to a fourth subpixel 59W included in each pixel 58 or fourth subpixels 59W included in a group of pixels 58 is inputted to a fourth subpixel 59W, the luminance of the fourth subpixel 59W is $BN_4$. That is to say, white which has the maximum luminance is displayed by a set of a first subpixel 59R, a second subpixel 59G, and a third subpixel 59B and the luminance of white is $BN_{1-3}$. As a result, the constant $\chi$ which depends on the display device 10 is expressed as $$\chi=BN_4/BN_{1-3}$$

By the way, if the display signal value $X4_{(p,q)}$ is given by the above expression (4), the maximum value Vmax(S) of a value is expressed, with the saturation S in the reproduction HSV color space as a variable, as:

If $S\leq S_0$, then $$Vmax(S)=(\chi+1)\cdot(2^n-1) \quad (7)$$

If $S_0<S\leq 1$, then $$Vmax(S)=(2^n-1)\cdot(1/S) \quad (8)$$

where $S_0=1/(\chi+1)$.

The maximum value Vmax(S) according to the variable, saturation S, in the reproduction HSV color space that has been extended by adding the fourth color is obtained in this way and is stored in the image processing device 30 as a type of lookup table, for example. Alternatively, the maximum value Vmax(S) according to the variable, saturation S, in the reproduction HSV color space is obtained every time by the image processing device 30.

The expansion coefficient $\alpha$ is used for expanding the value V(S) in the HSV color space into the reproduction HSV color space and is expressed as $$\alpha(S)=Vmax(S)/V(S) \quad (9)$$

In expansion calculation, the expansion coefficient $\alpha$ is determined on the basis of $\alpha(S)$ obtained for plural pixels 58, for example.

Signal processing performed by the image processing device 30 by the use of the expansion coefficient $\alpha$ will now be described. The following signal processing is performed so that the ratio among the luminance of the first primary color displayed by (first subpixel 59R+fourth subpixel 59W), the luminance of the second primary color displayed by (second subpixel 59G+fourth subpixel 59W), and the luminance of the third primary color displayed by (third subpixel 59B+fourth subpixel 59W) will be held, so that a color tone will be held (maintained), and so that a gradation-luminance characteristic (gamma ($\gamma$) characteristic) will be held (maintained). Furthermore, if all image signal values are 0 or small for a pixel 58 or a group of pixels 58, then the expansion coefficient $\alpha$ may be calculated with the pixel 48 or the group of pixels 58 excluded.

Processing performed by the required luminance value calculation section 33 will be described. On the basis of an image signal 81 for plural pixels 58 included in a block, the required luminance value calculation section 33 finds the saturation S and the value V(S) of the plural pixels 58. To be concrete, the required luminance value calculation section 33 uses image signal values $x1_{(p, q)}$, $x2_{(p, q)}$, and $x3_{(p, q)}$ of the image signal 81 corresponding to a (p, q)th pixel 58 and finds $S_{(p, q)}$ and $V(S)_{(p, q)}$ from expressions (5) and (6) respectively. The required luminance value calculation section 33 performs this processing on all pixels in the block. As a result, combinations of ($S_{(p, q)}$, $V(S)_{(p, q)}$) the number of which corresponds to the number of pixels 58 in the block are obtained. Next, the required luminance value calculation section 33 finds the expansion coefficient α on the basis of at least one of α(S) values found for the pixels 58 in the block. For example, the required luminance value calculation section 33 considers the smallest value of α(S) values found for the pixels 58 in the block as the expansion coefficient α for the block. The required luminance value calculation section 33 calculates the expansion coefficient α for the block in this way.

The required luminance value calculation section 33 repeats this procedure by blocks and calculates the expansion coefficient α for each block. Luminance required for a block is calculated by the use of 1/α which is the reciprocal of the expansion coefficient α.

As has been described, the expansion coefficient α is used for exercising division drive control of the luminance in the backlight 60 and image display control of the image display panel 40. By doing so, the luminance of the backlight 60 is set to the smallest value that enables color reproduction in the reproduction HSV color space by the display device 10. This reduces the power consumption of the display device 10. Furthermore, by controlling image display according to the luminance by pixels of the backlight 60, image quality is maintained and contrast is improved.

In the above description the required luminance value calculation section 33 uses the expansion coefficient α for calculating a required luminance value. The image processing section 35 may perform the same processing to generate a display signal 82. The image processing section 35 analyzes an image signal 81, finds an expansion coefficient α, and uses expressions (1), (2), (3), and (4) for calculating a display signal 82. The expansion coefficient α used in this way for calculating the display signal 82 and the expansion coefficient α calculated by the required luminance value calculation section 33 are not the same. Accordingly, by adjusting the display signal 82 by the use of pixel correspondence BL luminance information 87 calculated by the pixel correspondence BL luminance information calculation section 34, display is performed more properly.

Display control process performed by the display device 10 will now be described by the use of FIG. 12.

Figure 12:
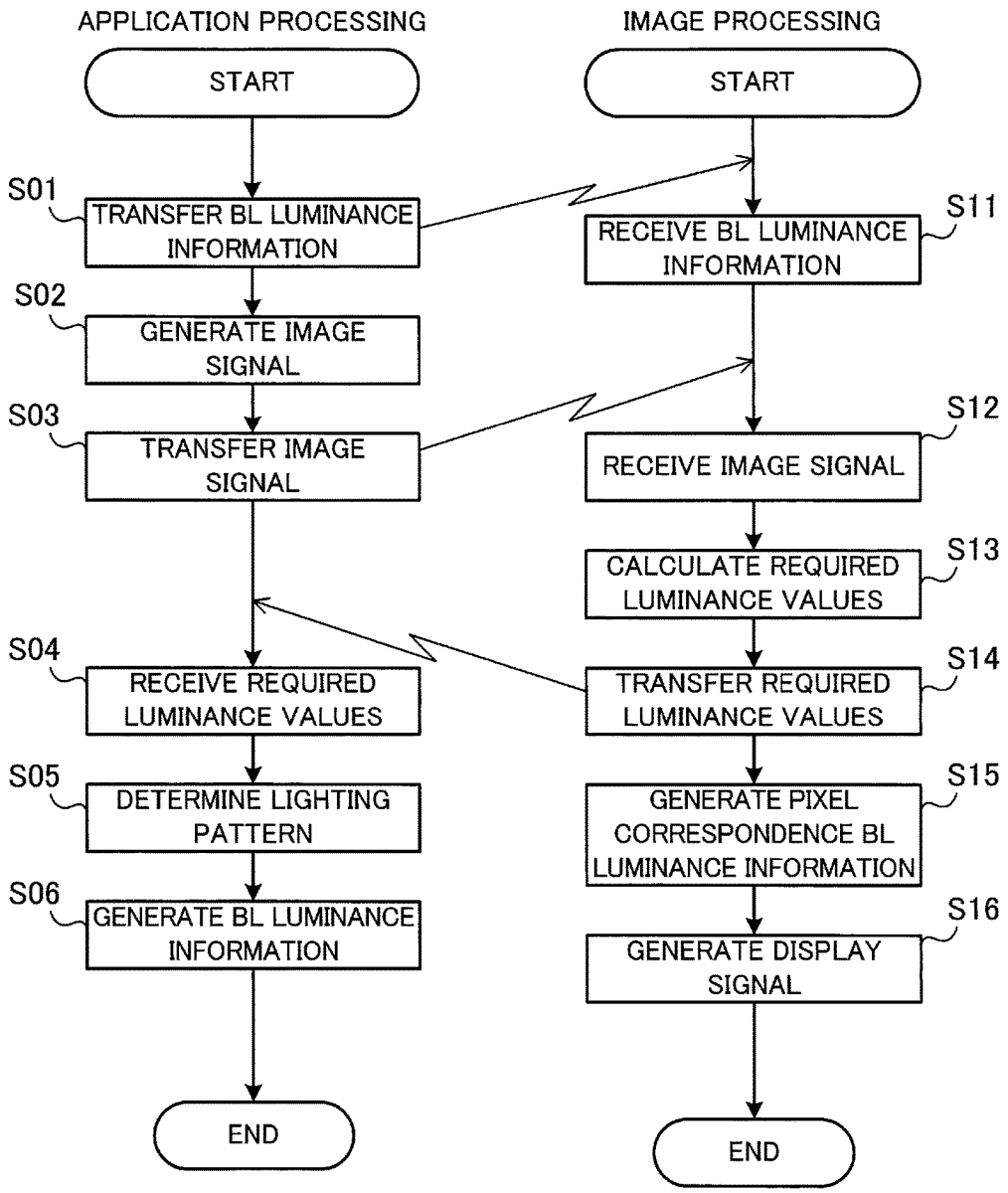
FIG. 12 is flow charts of subprocesses performed by an application processing device and an image processing device included in the display device according to the second embodiment.

FIG. 12 is flow charts of subprocesses performed by the application processing device and the image processing device included in the display device according to the second embodiment.

The application processing device 20 begins a subprocess every predetermined frame cycle.

(Step S01) The data transfer control section 21 transfers BL luminance information 86 generated by the BL luminance information generation section 25 to the image processing device 30. The BL luminance information 86 is calculated on the basis of an image signal 81 in the previous frame.

(Step S02) The image signal generation section 22 generates an image signal 81.

(Step S03) The data transfer control section 21 transfers the image signal 81 generated by the image signal generation section 22 to the image processing device 30.

(Step S04) The data transfer control section 21 receives required luminance values 85 from the image processing device 30. The required luminance values 85 are calculated on the basis of the image signal 81 transferred in step S03 to the image processing device 30.

(Step S05) The lighting pattern determination section 24 determines a lighting pattern 83 of the light sources 66 of the backlight 60 on the basis of the required luminance values 85 received in step S04 and the light-source-specific LUT 230 stored in the light-source-specific LUT storage section 23. A lighting amount of each light source 66 included in the sidelight light source 62 is set in the lighting pattern 83. The lighting pattern determination section 24 outputs the determined lighting pattern 83 to the light source drive section 70.

(Step S06) On the basis of the lighting pattern 83 determined in step S05 and the light-source-specific LUT 230, the BL luminance information generation section 25 generates BL luminance information 86 indicative of a luminance value of the backlight 60 at the time of driving the light sources 66 of the backlight 60 according to the lighting pattern 83. The BL luminance information 86 generated is held until it is transferred to the image processing device 30.

The above processing procedure is performed. That is to say, during image signal generation performed every frame cycle, the application processing device 20 determines a lighting pattern 83 of the light sources 66 of the backlight 60 and controls the backlight 60.

The operation of the image processing device 30 will be described.

(Step S11) The data transfer control section 31 receives the BL luminance information 86 transferred by the application processing device 20.

(Step S12) The data transfer control section 31 receives the image signal 81 transferred by the application processing device 20.

(Step S13) The required luminance value calculation section 33 calculates the required luminance values 85 by blocks on the basis of the image signal 81 received in step S12.

(Step S14) After the transfer of the image signal 81 from the application processing device 20 ends, the data transfer control section 31 transfers the required luminance values 85 generated by the required luminance value calculation section 33 to the application processing device 20.

(Step S15) The pixel correspondence BL luminance information calculation section 34 generates pixel correspondence BL luminance information 87 indicative of luminance information by pixels on the basis of the acquired BL luminance information 86. The pixel correspondence BL luminance information calculation section 34 performs interpolation calculation on the basis of luminance values of representative pixels included in the BL luminance information 86 to find luminance information by pixels, and generates the pixel correspondence BL luminance information 87.

(Step S16) The image processing section 35 generates a display signal 82 on the basis of the image signal 81 and the pixel correspondence BL luminance information 87 and outputs the display signal 82 to the image display panel drive section 50.

The above processing procedure is performed. That is to say, the image processing device 30 generates the display signal 82 and exercises display control of the image display panel 40. In the description of FIG. 12, the required luminance value calculation and the display signal generation are performed in turn. However, the required luminance value calculation and the display signal generation are performed in parallel.

(Third Embodiment)

A display device according to a third embodiment will now be described. In the second embodiment, the pixel correspondence BL luminance information calculation section 34 of the image processing device 30 generates the pixel correspondence BL luminance information 87. However, the application processing device 20 may generate pixel correspondence BL luminance information 87.

Figure 13:
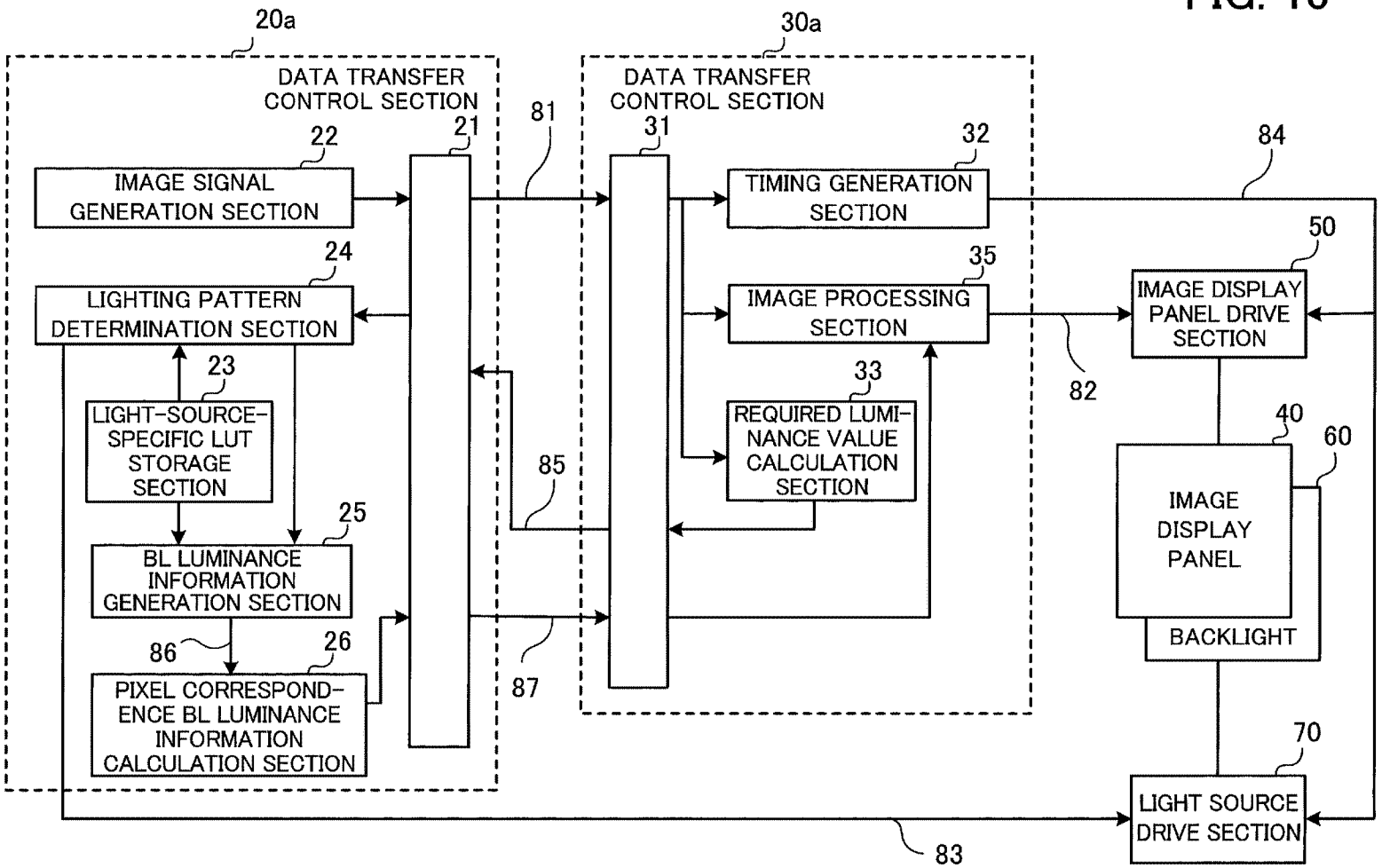
FIG. 13 is a functional block diagram of a display device according to a third embodiment.

FIG. 13 is a functional block diagram of a display device according to a third embodiment.

With a display device according to a third embodiment an application processing device 20*a* includes a data transfer control section 21, an image signal generation section 22, a light-source-specific LUT storage section 23, a lighting pattern determination section 24, a BL luminance information generation section 25, and a pixel correspondence BL luminance information calculation section 26.

On the basis of BL luminance information 86 including luminance information on representative pixels which is generated by the BL luminance information generation section 25, the pixel correspondence BL luminance information calculation section 26 performs interpolation calculation to obtain pixel correspondence BL luminance information 87 by pixels. In order to obtain the pixel correspondence BL luminance information 87, the pixel correspondence BL luminance information calculation section 26 uses the same method as the pixel correspondence BL luminance information calculation section 34 of the image processing device 30 illustrated in FIG. 6 uses. The data transfer control section 21 outputs the generated pixel correspondence BL luminance information 87 to an image processing device 30*a*. The data transfer control section 21 transfers BL luminance information 86 in a back porch period. This is the same with the second embodiment. That is to say, in the operation timing illustrated in FIG. 8, BL luminance information generation and pixel correspondence BL luminance information calculation are performed by the BL luminance information generation section 25 and the pixel correspondence BL luminance information calculation section 26, respectively, in place of each of the BL luminance information generation 251 and the BL luminance information generation 252. Furthermore, the BL luminance information 861 and the BL luminance information 862 are replaced with the pixel correspondence BL luminance information 87. The other steps in the third embodiment are the same as those in the second embodiment.

In the image processing device 30*a*, an image processing section 35 uses the pixel correspondence BL luminance information 87 received by a data transfer control section 31 at the time of converting an image signal 81 to a display signal 82.

The application processing device 20*a* performs calculation in this way for generating the pixel correspondence BL luminance information 87. This further reduces the load on the image processing device 30*a*.

(Fourth Embodiment)

A display device according to a fourth embodiment will now be described. In the third embodiment, a required luminance value calculation section 33 of the image processing device 30*a* calculates a required luminance value of a backlight 60. However, the application processing device 20*a* may calculate a required luminance value of the backlight 60.

Figure 14:
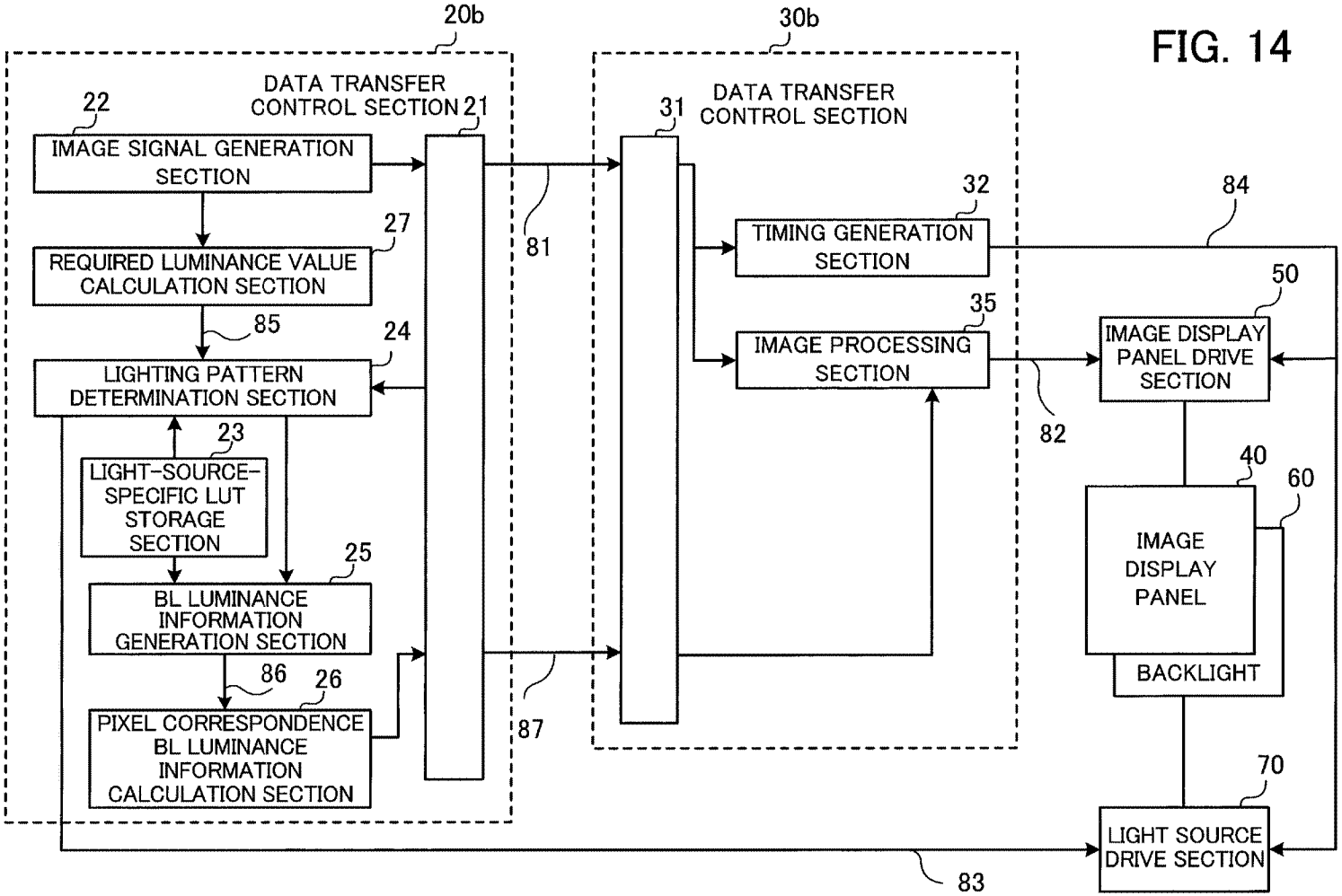
FIG. 14 is a functional block diagram of a display device according to a fourth embodiment.

FIG. 14 is a functional block diagram of a display device according to a fourth embodiment.

With a display device according to a fourth embodiment an application processing device 20*b* includes a data transfer control section 21, an image signal generation section 22, a light-source-specific LUT storage section 23, a lighting pattern determination section 24, a BL luminance information generation section 25, a pixel correspondence BL luminance information calculation section 26, and a required luminance value calculation section 27.

The required luminance value calculation section 27 calculates required luminance values 85 by blocks of a backlight 60 on the basis of an image signal 81 generated by the image signal generation section 22. The required luminance value calculation section 27 calculates the required luminance values 85 in the same way as with the required luminance value calculation section 33 of the image processing device 30 illustrated in FIG. 6. The lighting pattern determination section 24 uses the required luminance values 85.

In an image processing device 30*b*, a data transfer control section 31 receives pixel correspondence BL luminance information 87 and outputs the pixel correspondence BL luminance information 87 to an image processing section 35. The image processing section 35 generates a display signal 82 to be displayed on an image display panel 40 on the basis of the acquired pixel correspondence BL luminance information 87 and the image signal 81.

In the fourth embodiment the application processing device 20*b* includes the required luminance value calculation section 27, so the transfer of the required luminance values 851 and 852 illustrated in FIG. 8 is not performed. The application processing device 20*b* performs a required luminance value calculation before the lighting pattern determination 241 and the lighting pattern determination 242. The pixel correspondence BL luminance information 87 is transferred to the image processing device 30*b* in the same way as with the third embodiment.

The application processing device 20*b* performs a required luminance value calculation in this way. This further reduces the load on the image processing device 30*b*.

In the above embodiments, examples of a method for controlling the backlight 60 by the application processing device 20 and assigning a required luminance value calculation, BL luminance information generation, and pixel correspondence BL luminance information generation, which are involved in control of the backlight 60, to the application processing device 20 and the image processing device 30 are described. One of these methods may be selected according to the number of pixels, the processing capability of processors included in the application processing device 20 and the image processing device 30, or the like. Furthermore, another combination of steps may be assigned to the application processing device 20 and the image processing device 30.

The above processing functions can be realized with a computer. In that case, a program in which the contents of the functions that the display device should have are described is provided. By executing this program on the computer, the above processing functions are realized on the computer. This program may be recorded on a computer readable record medium. A computer readable record medium may be a magnetic recording device, an optical disk, a magneto-optical recording medium, a semiconductor memory, or the like. A magnetic recording device may be a HDD (Hard Disk Drive), a FD (Flexible Disk), a magnetic tape, or the like. An optical disk may be a DVD (Digital Versatile Disc), a DVD-RAM (Random Access Memory), a CD-ROM (Compact Disc Read Only Memory), a CD-R (Recordable)/RW(ReWritable), or the like. A magneto-optical recording medium may be a MO (Magneto-Optical disk) or the like.

To place the program on the market, portable record media, such as DVDs or CD-ROMs, on which it is recorded are sold. Alternatively, the program is stored in advance in a storage unit of a server computer and is transferred from the server computer to another computer via a network.

When a computer executes this program, it will store the program, which is recorded on a portable record medium or which is transferred from the server computer, in its storage unit, for example. Then the computer reads the program from its storage unit and performs processes in compliance with the program. The computer may read the program directly from a portable record medium and perform processes in compliance with the program. Furthermore, each time the program is transferred from the server computer connected via a network, the computer may perform processes in order in compliance with the program it receives.

In addition, at least a part of the above processing functions may be realized by an electronic circuit such as a DSP (Digital Signal Processor), an ASIC (Application Specific Integrated Circuit), or a PLD (Programmable Logic Device).

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that various changes, substitutions, and alterations could be made hereto without departing from the spirit and scope of the invention.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A display device comprising:

an image display panel on which pixels are arranged;

a panel driver which drives the pixels;

a backlight which lights the image display panel from a rear of the image display panel;

a light source driver coupled to the backlight;

an application processing device including a central processing unit and a first data transfer controller; and an image processing device including a display driver integrated circuit and a second data transfer controller connected to the first data transfer controller, wherein the first data transfer controller transmits data generated by the central processing unit to the second data transfer controller or receives data generated by the display driver integrated circuit from the second data transfer controller, wherein the second data transfer controller transmits data generated by the display driver integrated circuit to the first data transfer controller or receives data generated by the central processing unit from the first data transfer controller, wherein the central processing unit is connected directly to the light source driver, the display driver integrated circuit is coupled to the panel driver, and a processing speed of the central processing unit is higher than that of the display driver integrated circuit, wherein the central processing unit generates an image signal and the first data transfer controller outputs the image signal to the second data transfer controller, and wherein the display driver integrated circuit converts the image signal to a display signal for controlling display of the image display panel on the basis of a light source lighting amount, wherein:

the central processing unit stores luminance distribution information and determines a lighting pattern of the backlight on the basis of the luminance distribution information by adjusting the light source lighting amount of each light source on the basis of a required luminance value of the backlight, the central processing unit generates a backlight luminance information at the time of lighting the light source of the backlight according to the lighting pattern and the first data transfer controller outputs the backlight luminance information to the second data transfer controller and the central processing unit directly outputs the lighting pattern to the light source driver in a period for which the image signal is not transferred, the display driver integrated circuit performs in parallel both converting the image signal to the display signal based on the backlight luminance information and calculating the required luminance value, the display driver integrated circuit outputs the display signal to the panel driver which controls the image display panel and the second data transfer controller outputs the required luminance value to the first data transfer controller in a period after an end of input of the image signal and before input of the image signal in a next cycle, and the display driver integrated circuit includes a timing generator which outputs a synchronization signal, the synchronization signal is transmitted directly to the panel driver and the light source driver, and the panel driver and the light source driver drive the image display panel and the backlight respectively, in synchronization with each other by the synchronization signal.

2. The display device according to claim 1, wherein:

the backlight includes a plurality of light sources which can operate independently of one another;

the luminance distribution information includes luminance distribution information by light source unit which is a combination of one or more light sources of the plurality of light sources; and the central processing unit determines the lighting pattern in which a light source lighting amount of each light source unit is adjusted on the basis of the luminance distribution information by light source unit, and controls the backlight on the basis of the lighting pattern.

3. The display device according to claim 1, wherein:

the display driver integrated circuit calculates, on the basis of at least one of a saturation and a value of the image signal for each block, a block correspondence index for adjusting luminance of the backlight corresponding to said each block, calculates the required luminance value on the basis of the block correspondence index.

4. The display device according to claim 1, wherein:

the display driver integrated circuit acquires the backlight luminance information, calculates, at the time of the backlight luminance information being luminance information on representative pixels which represent pixels in determined areas of a display surface of the image display panel, luminance information on each pixel by interpolation calculations to generate pixel correspondence backlight luminance information.

5. A method for driving a display device, the display device including:

an image display panel on which pixels are arranged, a panel driver which drives the pixels, a backlight which lights the image display panel from a rear of the image display panel, a light source driver coupled to the backlight, an application processing device including a central processing unit and a first data transfer controller; and an image processing device including a display driver integrated circuit and a second data transfer controller connected to the first data transfer controller, the first data transfer controller transmitting data generated by the central processing unit to the second data transfer controller or receiving data generated by the display driver integrated circuit from the second data transfer controller, the second data transfer controller transmitting data generated by the display driver integrated circuit to the first data transfer controller or receiving data generated by the central processing unit from the first data transfer controller, the central processing unit being connected directly to the light source driver, a processing speed of the application processing device being higher than that of the image processing device, the method comprising:

generating, by the central processing unit, an image signal and outputting, by the first data transfer controller, the image signal to the second data transfer controller; and converting, by the display driver integrated circuit, the image signal to a display signal for controlling display of the image display panel on the basis of a light source lighting amount wherein:

the central processing unit stores luminance distribution information and determines a lighting pattern of the backlight on the basis of the luminance distribution information by adjusting the light source lighting amount of each light source on the basis of a required luminance value of the backlight, the central processing unit generates a backlight luminance information at the time of lighting the light source of the backlight according to the lighting pattern and the first data transfer controller outputs the backlight luminance information to the second data transfer controller and the central processing unit directly outputs the lighting pattern to the light source driver in a period for which the image signal is not transferred, the display driver integrated circuit performs in parallel both converting the image signal to the display signal based on the backlight luminance information and calculating the required luminance value, the display driver integrated circuit outputs the display signal to the panel driver which controls the image display panel and the second data transfer controller outputs the required luminance value to the first data transfer controller in a period after an end of input of the image signal and before input of the image signal in a next cycle, and the display driver integrated circuit includes a timing generator which outputs a synchronization signal, the synchronization signal is transmitted directly to the panel driver and the light source driver, and the panel driver and the light source driver drive the image display panel and the backlight respectively, in synchronization with each other by the synchronization signal.

* * * * *